US010308033B2

(12) United States Patent
Sato et al.

(10) Patent No.: US 10,308,033 B2
(45) Date of Patent: Jun. 4, 2019

(54) IMAGE RECORDING APPARATUS CAPABLE OF RESTRAINING ENTRY OF AIR TO RECORDING PORTION

(71) Applicant: BROTHER KOGYO KABUSHIKI KAISHA, Nagoya-shi, Aichi-ken (JP)

(72) Inventors: Masatake Sato, Nagoya (JP); Akinari Ishibe, Okazaki (JP); Yuma Tanabe, Nagoya (JP); Masahiro Hayashi, Nagoya (JP); Akihito Kobayashi, Konan (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 18 days.

(21) Appl. No.: 15/717,118

(22) Filed: Sep. 27, 2017

(65) Prior Publication Data

US 2018/0178532 A1 Jun. 28, 2018

(30) Foreign Application Priority Data

Dec. 28, 2016 (JP) ..... 2016-256359

(51) Int. Cl.
*B41J 2/175* (2006.01)
*B41J 2/19* (2006.01)
(Continued)

(52) U.S. Cl.
CPC ..... *B41J 2/17523* (2013.01); *B41J 2/1752* (2013.01); *B41J 2/1753* (2013.01);
(Continued)

(58) Field of Classification Search
CPC .... B41J 2/17523; B41J 2/1752; B41J 2/1753; B41J 2/19; B41J 2/17536; B41J 2/17553; B41J 29/38; B41J 29/13
See application file for complete search history.

(56) References Cited

U.S. PATENT DOCUMENTS

2009/0201351 A1* 8/2009 Shimizu ..... B41J 2/17509 347/87
2013/0187985 A1* 7/2013 Katoh ..... B41J 2/175 347/47

(Continued)

FOREIGN PATENT DOCUMENTS

JP 2008-238792 A 10/2008

*Primary Examiner* — Kristal Feggins
(74) *Attorney, Agent, or Firm* — Merchant & Gould P.C.

(57) ABSTRACT

An image recording apparatus includes: a cartridge; a cartridge attachment portion; and a switching portion. The cartridge includes: a first storage chamber; a first air communication portion; and a first supply portion. The cartridge attachment portion includes: a second storage chamber; and a second air communication portion. The switching portion changes a passage resistance value of air flowing through one of the first and second air communication portions. An inequality of R2>A×R1 is met, in which R1: a passage resistance value obtained by air flowing through the first air communication portion and a passage resistance value of the liquid flowing through the first supply portion; R2: a passage resistance value of air flowing through the second air communication portion; A: a cross-sectional area ratio obtained by dividing an average cross-sectional area of the first storage chamber by an average cross-sectional area of the second storage chamber.

10 Claims, 12 Drawing Sheets

(51) Int. Cl.
*B41J 29/13* (2006.01)
*B41J 29/38* (2006.01)

(52) U.S. Cl.
CPC ..... *B41J 2/17536* (2013.01); *B41J 2/17553* (2013.01); *B41J 2/19* (2013.01); *B41J 29/13* (2013.01); *B41J 29/38* (2013.01)

(56) References Cited

U.S. PATENT DOCUMENTS

2016/0059571 A1* 3/2016 Kobayashi ..... B41J 2/17513 347/7
2018/0056664 A1* 3/2018 Koike ..... B41J 2/17509

* cited by examiner

IMAGE RECORDING APPARATUS CAPABLE OF RESTRAINING ENTRY OF AIR TO RECORDING PORTION

CROSS REFERENCE TO RELATED APPLICATION

This application claims priority from Japanese Patent Application No. 2016-256359 filed on Dec. 28, 2016. The entire content of the priority application is incorporated herein by reference.

TECHNICAL FIELD

The present disclosure relates to an image recording apparatus including a cartridge having a first storage chamber and a cartridge attachment portion having a second storage chamber.

BACKGROUND

Japanese Patent Application Publication No. 2008-238792 discloses a liquid ejection device including a main body and an ink cartridge. The main body includes a liquid ejection head and a sub-tank. The ink cartridge has a liquid storage chamber and is detachably attachable to the main body. A sensor arm is provided in the liquid storage chamber. The sensor arm is pivotally moved when a liquid level of ink in the liquid storage chamber becomes equal to or less than a predetermined level. A residual amount detection sensor is provided in the main body. The residual amount detection sensor outputs detection signals different from each other depending on pivotally moving position of the sensor arm. A residual amount of ink in the liquid storage chamber is determined on a basis of the detection signal transmitted from the residual amount detection sensor. A message indicative of prompting replacement of the ink cartridge with a new cartridge is notified when the residual amount of ink in the liquid storage chamber becomes equal to or less than a predetermined amount in accordance with consumption of ink in the liquid storage chamber.

SUMMARY

As ink flows out of the sub-tank, ink in the liquid storage chamber flows into the sub-tank. A liquid level of ink in the sub-tank is eventually equal to a liquid level of ink in the liquid storage chamber in a case where both the sub-tank and the liquid storage chamber are in communication with an atmosphere. Here, in a case where ink is ejected at a recording head, an amount of ink flowing out of the sub-tank would be approximately equal to an amount of ink flowing out of the liquid storage chamber ignoring a passage resistance at the sub-tank and a passage resistance at the liquid storage chamber. However, a descending speed of the liquid level of ink may be different between the sub-tank and the liquid storage chamber due to difference in shape therebetween. As a result, the liquid level of ink in the sub-tank becomes different from the liquid level of ink in the liquid storage chamber.

For example, air may be entered into the recording head from the sub-tank if ink becomes empty in the sub-tank whereas ink remains in the liquid storage chamber. In order to overcome this problem, a structure enabling an amount of ink flowing from the liquid storage chamber to the sub-tank to be greater than an amount of ink flowing from the sub-tank to the recording head is conceivable by setting a passage resistance at a passage from the sub-tank to the recording head greater than a passage resistance at a passage from the liquid storage chamber to the sub-tank.

However, in a case where ink stored in the liquid storage chamber of an ink cartridge attached to the cartridge attachment portion is consumed and a new ink cartridge is attached to the cartridge attachment portion, inflow of ink from the liquid storage chamber of the new ink cartridge to the sub-tank may be difficult to achieve in accordance with an increase in passage resistance at the passage from the sub-tank to the recording head.

In view of the foregoing, it is an object of the disclosure to provide an image recording apparatus including: a cartridge having a first storage chamber; and a cartridge attachment portion having a second storage chamber, the apparatus being capable of restraining entry of air from the second storage chamber to a recording portion, and enhancing liquid flowing performance between the first storage chamber and the second storage chamber.

In order to attain the above and other objects, according to one aspect, the disclosure provides an image recording apparatus including: a cartridge; a cartridge attachment portion; a recording portion; and a switching portion. The cartridge includes: a first storage chamber configured to store a liquid therein; a first air communication portion allowing the first storage chamber to communicate with an atmosphere; and a first supply portion configured to supply the liquid stored in the first storage chamber. The cartridge attachment portion includes: a connecting portion configured to be connected to the first supply portion; a second storage chamber configured to store therein the liquid supplied from the first supply portion connected to the connecting portion; and a second air communication portion allowing the second storage chamber to communicate with the atmosphere. The recording portion includes a nozzle through which liquid supplied from the second storage chamber is ejected. The switching portion is configured to change a passage resistance value of a flow of air flowing through one of the first air communication portion and the second air communication portion. An inequality of $R2>A\times R1$ is met, in which R1: a first passage resistance value obtained by a sum of the passage resistance value of the flow of air flowing through the first air communication portion and a passage resistance value of a flow of the liquid flowing through the first supply portion; R2: a second passage resistance value of the flow of air flowing through the second air communication portion; and A: a cross-sectional area ratio obtained by dividing a first average cross-sectional area by a second average cross-sectional area, in which the first average cross-sectional area is an average cross-sectional area of a first space of the first storage chamber, the first space containing a portion adjacent to the first supply portion and storing the liquid, and the second average cross-sectional area is an average cross-sectional area of a second space of the second storage chamber, the second space having a height the same as that of the first space and containing a portion in which the liquid is stored.

According to another aspect, the disclosure provides an image recording apparatus including: a cartridge; a cartridge attachment portion; a recording portion; a switching portion; a controller; and a detecting portion. The cartridge includes: a first storage chamber configured to store a liquid therein; a first air communication portion allowing the first storage chamber to communicate with an atmosphere; and a first supply portion configured to supply the liquid stored in the first storage chamber. The cartridge attachment portion includes: a connecting portion configured to be connected to the first supply portion; a second storage chamber configured to store therein the liquid supplied from the first supply portion connected to the connecting portion; and a second air communication portion allowing the second storage chamber to communicate with the atmosphere. The recording portion includes a nozzle through which liquid supplied from the second storage chamber is ejected. The switching portion is configured to change a passage resistance value of a flow of air flowing through the second air communication portion. The controller is configured to control operation of the switching portion to set the passage resistance value at the second air communication portion to one of a first value and a second value, the first value being higher than the second value. The detecting portion is configured to detect attachment of the cartridge to the cartridge attachment portion. The controller operates the switching portion to set the passage resistance value at the second air communication portion to the second value subject to receipt of a signal indicative of a change from non-attachment to attachment of the cartridge to the cartridge attachment portion from the detecting portion. The controller further operates the switching portion to set the passage resistance value at the second air communication portion to the first value during operation of the recording portion.

According to still another aspect, the disclosure provides an image recording apparatus including: a cartridge; a cartridge attachment portion; a recording portion; a switching portion; and a controller. The cartridge includes: a first storage chamber configured to store a liquid therein; a first air communication portion allowing the first storage chamber to communicate with an atmosphere; and a first supply portion configured to supply the liquid stored in the first storage chamber. The cartridge attachment portion includes: a connecting portion configured to be connected to the first supply portion; a second storage chamber configured to store therein the liquid supplied from the first supply portion connected to the connecting portion; and a second air communication portion allowing the second storage chamber to communicate with the atmosphere. The recording portion includes a nozzle through which liquid supplied from the second storage chamber is ejected. The switching portion is configured to change a passage resistance value of a flow of air flowing through the second air communication portion. The controller is configured to control operation of the switching portion to set the passage resistance value at the second air communication portion to one of a first value and a second value, the first value being higher than the second value. The controller operates the switching portion to set the passage resistance value at the second air communication portion to the first value during operation of the recording portion and to set the passage resistance value at the second air communication portion to the second value during non-operation of the recording portion.

BRIEF DESCRIPTION OF THE DRAWINGS

The particular features and advantages of the embodiment (s) as well as other objects will become apparent from the following description taken in connection with the accompanying drawings, in which.

DETAILED DESCRIPTION

Figure 1A:
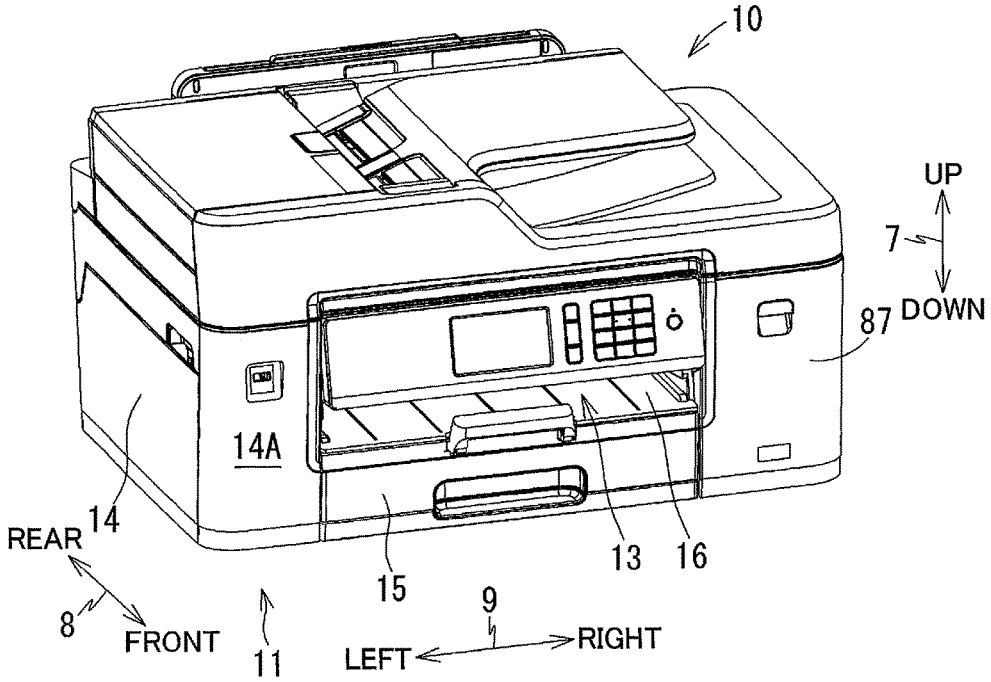
FIG. 1A is a perspective view of a multifunction peripheral 10 according to one embodiment, illustrating a closed position of a cover 87 of the multifunction peripheral 10.

A multifunction peripheral 10 as an example of an image recording apparatus according to one embodiment will be described with reference to the accompanying drawings, wherein like parts and components are designated by the same reference numerals to avoid duplicating description.

In the following description, up, down, front, rear, left, and right directions related to the multifunction peripheral 10 will be given based on a posture of the multifunction peripheral 10 disposed on a horizontal plane in its operable state, that is, a posture illustrated in FIG. 1A. Note that the posture illustrated in FIG. 1A will also be referred to as an "operable posture". An up-down direction 7 is defined with reference to the operable posture of the multifunction peripheral 10. A front-rear direction 8 is defined assuming that a surface of the multifunction peripheral 10 formed with an opening 13 is a front surface of the multifunction peripheral 10. A left-right direction 9 is defined as a direction that the multifunction peripheral 10 is viewed from its front side. In the present embodiment, in the operable posture of the multifunction peripheral 10, the up-down direction 7 is parallel to a vertical direction, and the front-rear direction 8 and the left-right direction 9 are parallel to a horizontal direction. Further, the front-rear direction 8 is perpendicular to the left-right direction 9.

<Overall Structure of Multifunction Peripheral 10>

Figure 1B:
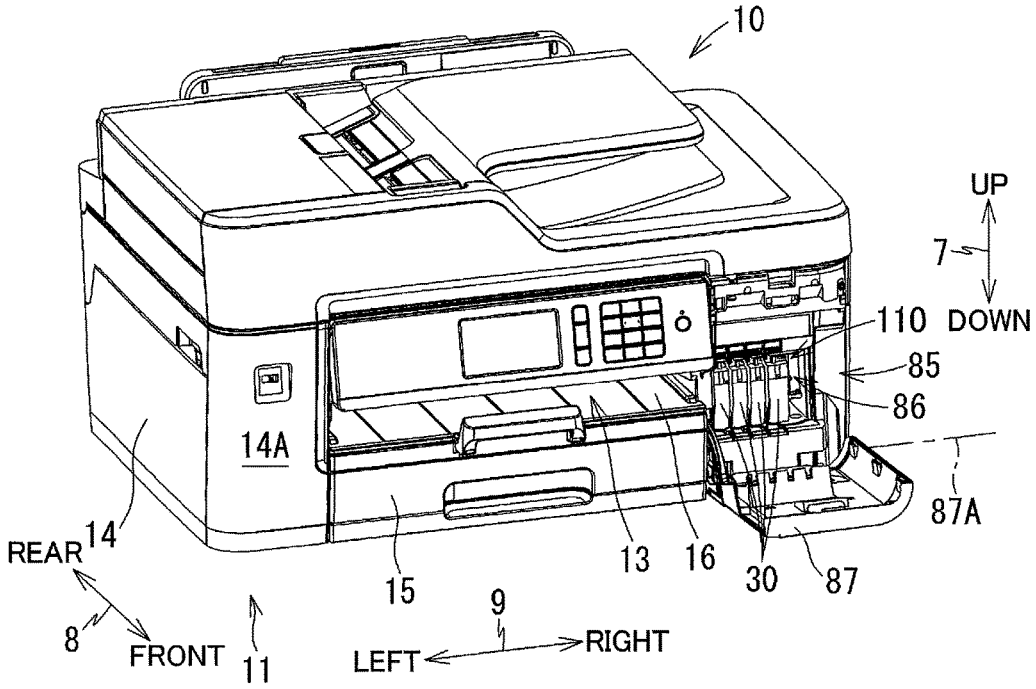
FIG. 1B is a perspective view of the multifunction peripheral 10 according to the embodiment, illustrating an open position of the cover 87.

As illustrated in FIGS. 1A and 1B, the multifunction peripheral 10 has a substantially rectangular parallelepiped shape. The multifunction peripheral 10 has a printer portion 11 at its lower portion. The printer portion 11 includes a casing 14 having a front surface 14A formed with the opening 13. The printer portion 11 is configured to record an image on a sheet of paper 12 (see FIG. 2) based on an inkjet recording method.

Figure 2:
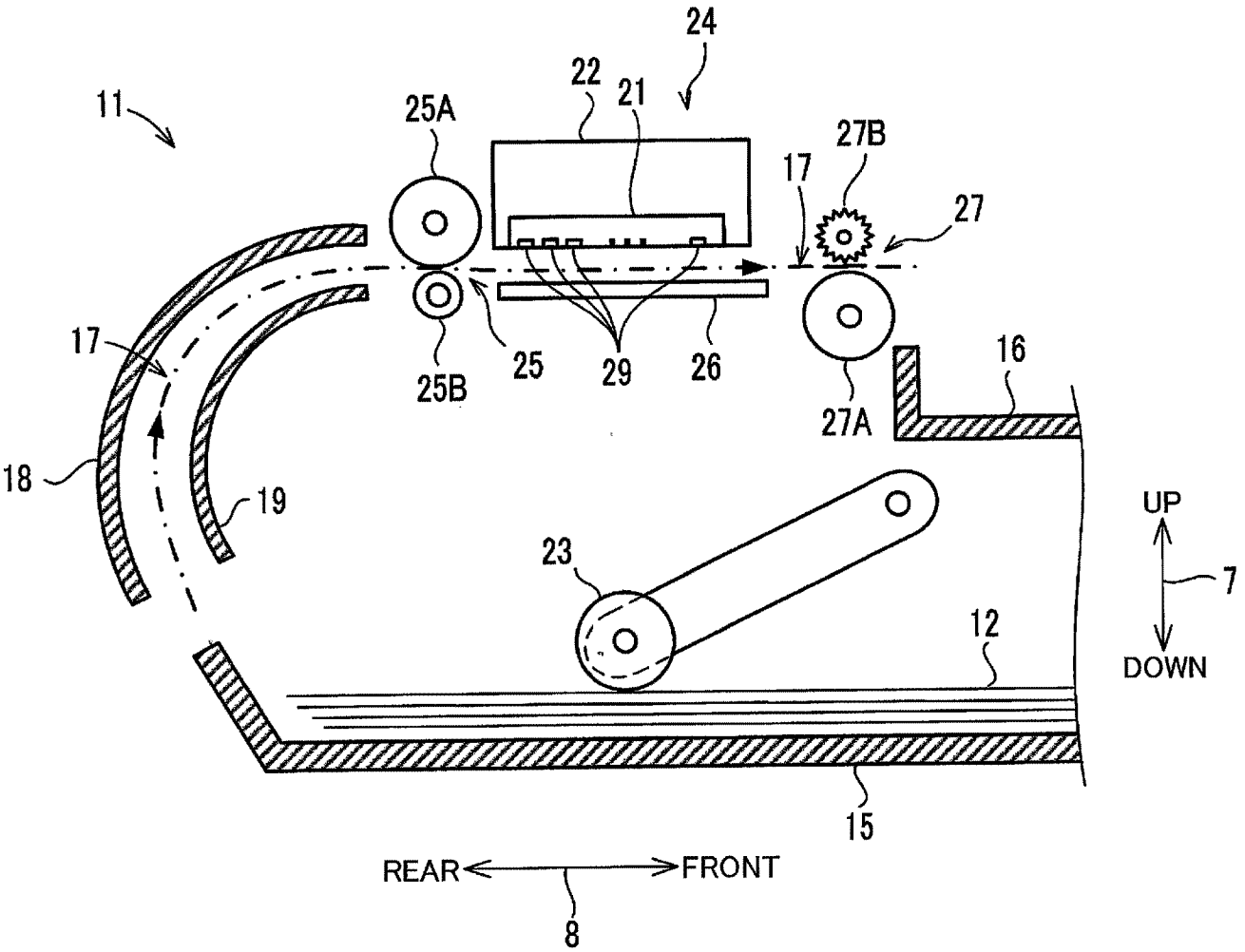
FIG. 2 is a vertical cross-sectional view schematically illustrating an internal configuration of a printer portion 11 of the multifunction peripheral 10 according to the embodiment.

The printer portion 11 also includes a feeding roller 23, a feeding tray 15, a discharging tray 16, a pair of conveying rollers 25, a recording portion 24, a pair of discharging rollers 27, a platen 26, and a cartridge attachment portion 110. As illustrated in FIGS. 1A, 1B, and 2, these components are arranged within the casing 14.

The multifunction peripheral 10 has various functions such as a facsimile function and a printing function. As described above, the posture of the multifunction peripheral 10 illustrated in FIG. 1A is the operable posture of the multifunction peripheral 10.

<Feeding Tray 15, Discharging Tray 16, and Feeding Roller 23>

As illustrated in FIGS. 1A and 1B, the feeding tray 15 can be inserted into and extracted from the casing 14 by a user in the front-rear direction 8 through the opening 13. The opening 13 is positioned at a center portion of the front surface 14A of the casing 14 in the left-right direction 9. As illustrated in FIG. 2, the feeding tray 15 can support stacked sheets 12 thereon.

The discharging tray 16 is disposed above the feeding tray 15. The discharging tray 16 supports the sheets 12 discharged by the discharging rollers 27 from a position between the recording portion 24 and the platen 26.

The feeding roller 23 feeds the sheets 12 supported by the feeding tray 15 onto a conveyance path 17. The feeding roller 23 is driven by a feeding motor 172 (see FIG. 8).

<Conveyance Path 17>

As illustrated in FIG. 2, the conveyance path 17 is a space partially defined by an outer guide member 18 and an inner guide member 19 opposing each other at a predetermined interval inside the printer portion 11. The conveyance path 17 extends rearward from a rear end portion of the feeding tray 15, and then, U-turns frontward while extending upward at a rear portion of the printer portion 11, and passes through a space between the recording portion 24 and the platen 26, and reaches the discharging tray 16. A part of the conveyance path 17 positioned between the conveying rollers 25 and the discharging rollers 27 is provided substantially at a center portion of the multifunction peripheral 10 in the left-right direction 9, and extends in the front-rear direction 8. A conveying direction of the sheet 12 in the conveyance path 17 is indicated by a dashed-dotted arrow in FIG. 2.

<Conveying Rollers 25>

As illustrated in FIG. 2, the pair of conveying rollers 25 is disposed in the conveyance path 17. The conveying rollers 25 include a conveying roller 25A and a pinch roller 25B. The conveying roller 25A and the pinch roller 25B are opposed to each other. The conveying roller 25A is driven by a conveying motor 171 (see FIG. 8). The pinch roller 25B is rotated in conjunction with rotation of the conveying roller 25A. The sheet 12 is nipped between the conveying roller 25A and the pinch roller 25B while the conveying roller 25A is rotated in a normal direction in response to normal rotation of the conveying motor 171, thereby being conveyed in the conveying direction (i.e., frontward direction).

<Discharging Rollers 27>

As illustrated in FIG. 2, the pair of discharging rollers 27 is disposed downstream relative to the pair of conveying rollers 25 on the conveyance path 17 in the conveying direction. The discharging rollers 27 include a discharging roller 27A and a spur 27B. The discharging roller 27A and the spur 27B are opposed to each other. The discharging roller 27A is driven by the conveying motor 171 (see FIG. 8). The spur 27B is rotated in conjunction with rotation of the discharging roller 27A. The sheet 12 is nipped between the discharging roller 27A and the spur 27B while the discharging roller 27A is rotated in a normal direction in response to the normal rotation of the conveying motor 171, thereby being conveyed in the conveying direction (i.e., frontward direction).

<Recording Portion 24>

As illustrated in FIG. 2, the recording portion 24 is disposed between the conveying rollers 25 and the discharging rollers 27 on the conveyance path 17. The recording portion 24 is arranged to oppose the platen 26 in the up-down direction 7, with the conveyance path 17 interposed between the recording portion 24 and the platen 26. The recording portion 24 includes a carriage 22 and a recording head 21.

Figure 3:
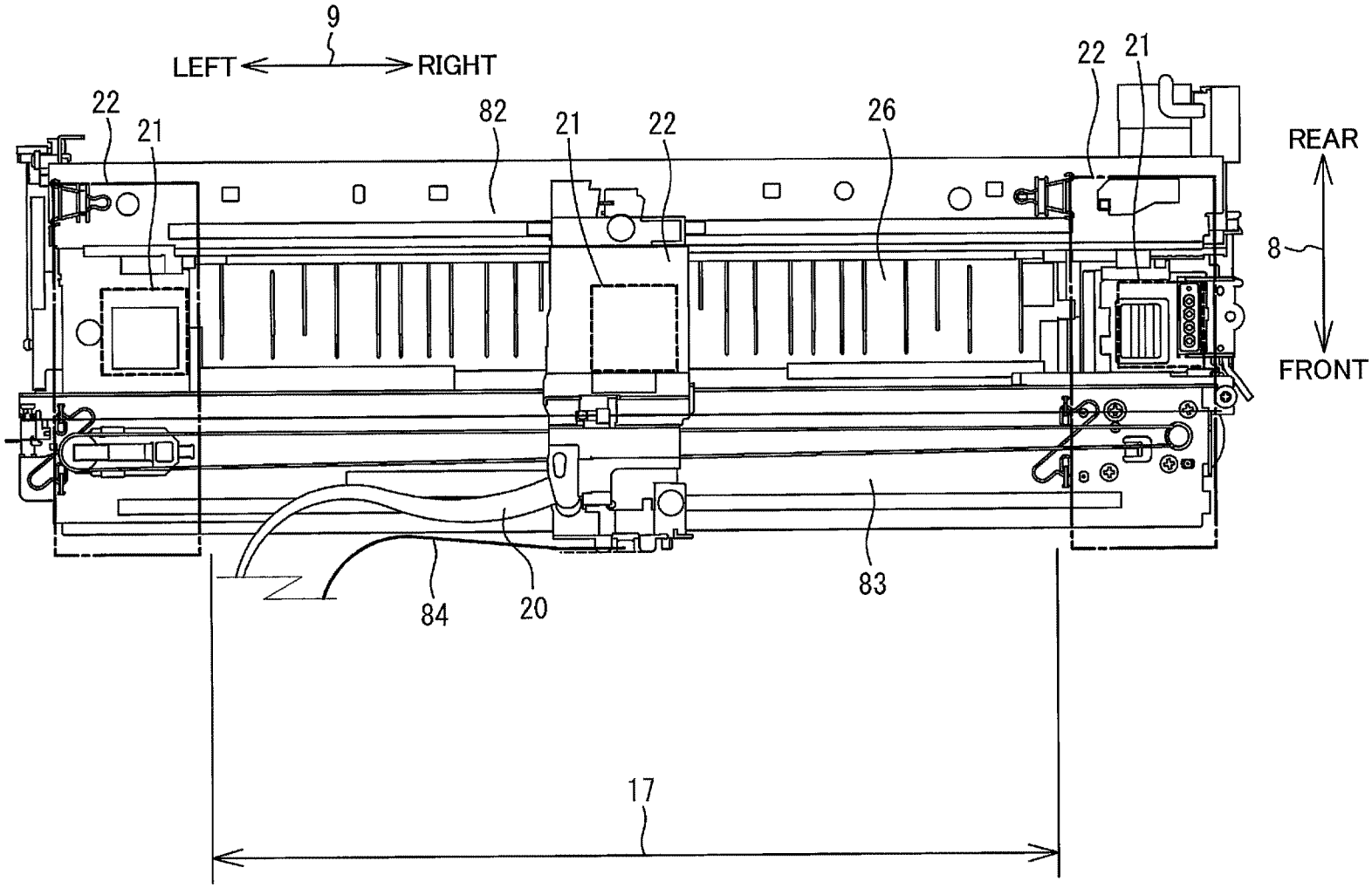
FIG. 3 is a plan view illustrating a positional relationship between a carriage 22 and a platen 26 of the multifunction peripheral 10 according to the embodiment.

As illustrated in FIG. 3, guide rails 82 and 83 extend in the left-right direction 9 at positions spaced apart from each other in the front-rear direction 8 and are supported by a frame of the printer portion 11. The carriage 22 is supported by the guide rails 82 and 83. The carriage 22 is connected to a known belt mechanism provided at the guide rail 83. The belt mechanism is driven by a carriage driving motor 173 (see FIG. 8). The carriage 22 connected to the belt mechanism reciprocates in the left-right direction 9 in response that the carriage driving motor 173 is driven. Movement of the carriage 22 spans a range from a right side relative to a right end of the conveyance path 17 to a left side relative to a left end of the conveyance path 17, as indicated by alternate long and short dash lines in FIG. 3.

As illustrated in FIG. 3, ink tubes 20 and a flexible flat cable 84 extend from the carriage 22.

The ink tubes 20 connect the cartridge attachment portion 110 (see FIG. 1B) and the recording head 21. The ink tubes 20 each supply the recording head 21 with ink stored in corresponding one of ink cartridges 30 attached to the cartridge attachment portion 110. Four ink tubes 20 through which ink of respective four colors (black, magenta, cyan, and yellow) flows are provided in one-to-one correspondence with four ink cartridges 30. These four ink tubes 20 are connected to the carriage 22 in a bundled state.

The flexible flat cable 84 electrically connects a controller 130 (see FIG. 8) and the recording head 21. The flexible flat cable 84 transmits control signals outputted from the controller 130 to the recording head 21.

As illustrated in FIG. 2, the carriage 22 carries the recording head 21. The recording head 21 includes a plurality of nozzles 29 and a piezoelectric element 45 (see FIG. 8). The nozzles 29 are arranged on a lower surface of the recording head 21. The piezoelectric element 45 is configured to deform a part of an ink flow passage formed in the recording head 21 to cause ink droplets to be ejected through the nozzles 29. As will be described later in detail, the piezoelectric element 45 is configured to operate when electric power is supplied by the controller 130.

The recording portion 24 is controlled by the controller 130. When the carriage 22 moves in the left-right direction 9, the recording head 21 ejects ink droplets from the nozzles 29 onto the sheet 12 supported by the platen 26. In this way, an image is recorded on the sheet 12. Further, the ink stored in each ink cartridge 30 is consumed.

<Platen 26>

As illustrated in FIGS. 2 and 3, the platen 26 is disposed between the conveying rollers 25 and the discharging rollers 27 on the conveyance path 17. The platen 26 is arranged to oppose the recording portion 24 in the up-down direction 7, with the conveyance path 17 interposed between the platen 26 and the recording portion 24. The platen 26 supports the sheet 12 conveyed by the conveying rollers 25 from below.

<Cover 87>

As illustrated in FIG. 1B, an opening 85 is formed in the front surface 14A of the casing 14 at a right end portion thereof. A storage space 86 capable of accommodating the cartridge attachment portion 110 therein is formed at a position rearward of the opening 85. A cover 87 is attached to the casing 14 to cover the opening 85. The cover 87 is pivotally movable about a pivot axis 87A (pivot center) extending in the left-right direction 9 between a closed position (a position illustrated in FIG. 1A) for closing the opening 85 and an open position (a position illustrated in FIG. 1B) for opening the opening 85.

<Cartridge Attachment Portion 110>

Figure 4:
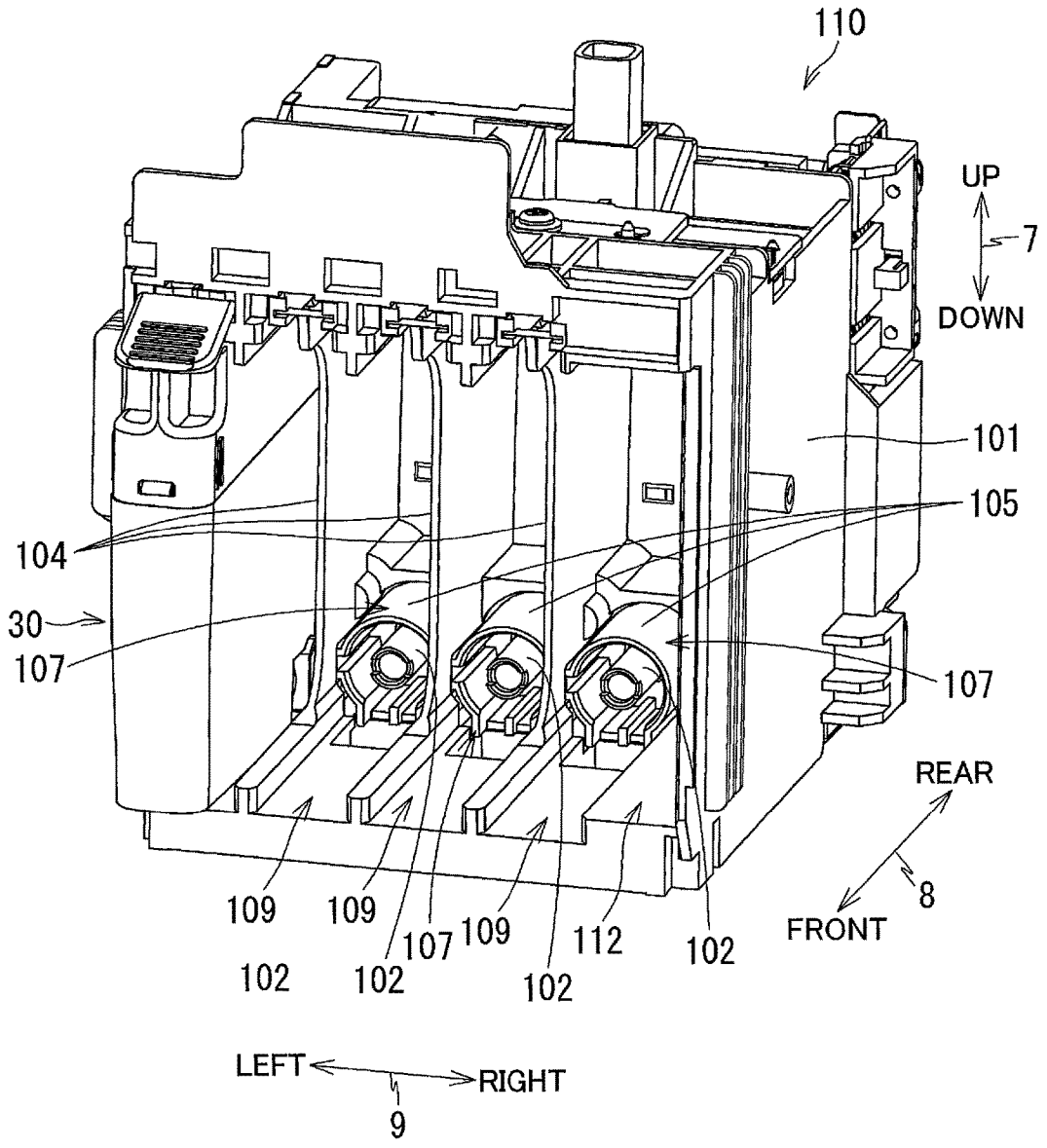
FIG. 4 is a perspective view of a cartridge attachment portion 110 provided in the multifunction peripheral 10 and formed with an opening 112 as viewed from a front side thereof according to the embodiment.
Figure 5:
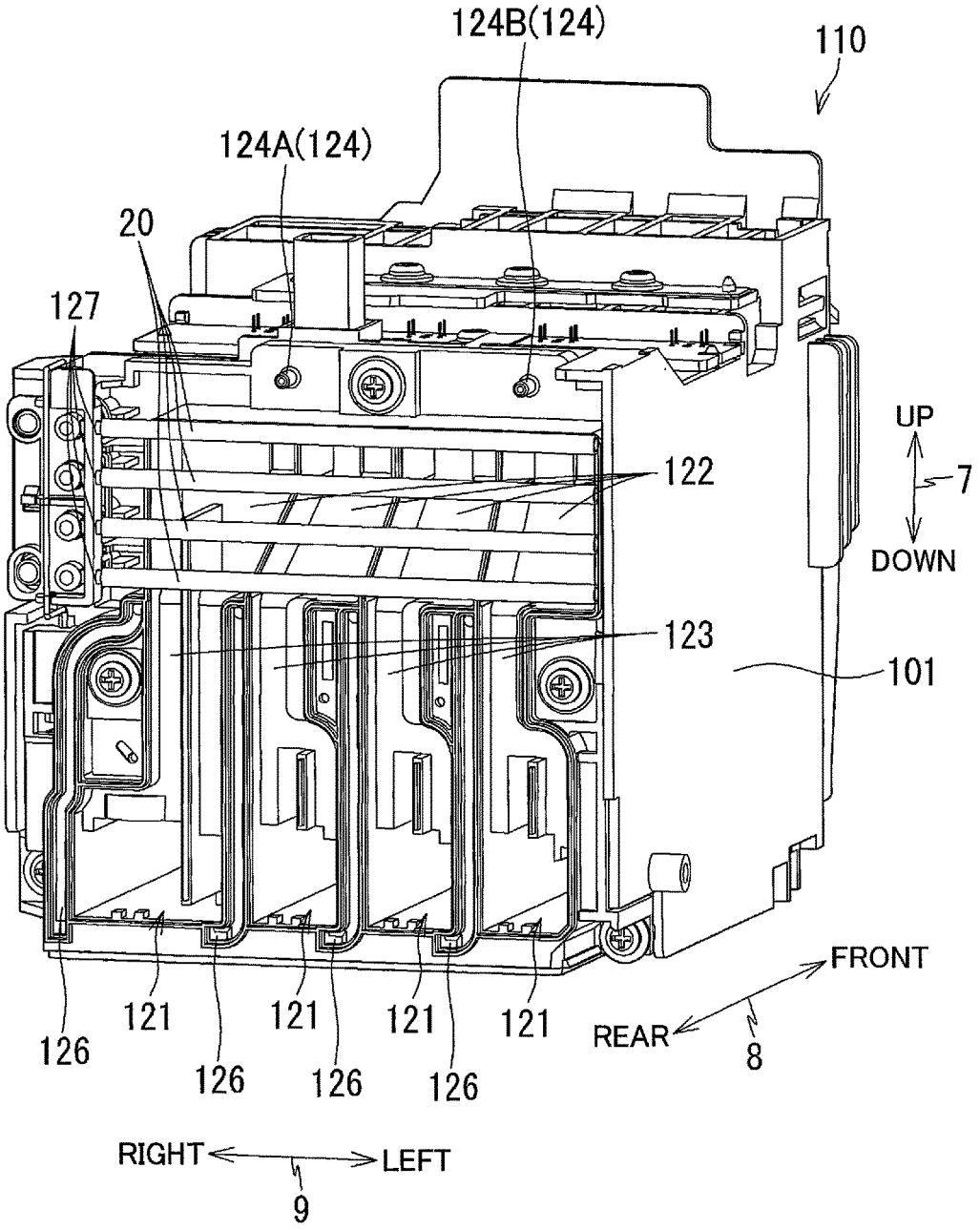
FIG. 5 is a perspective view of the cartridge attachment portion 110 as viewed from a rear side thereof according to the embodiment.
Figure 6:
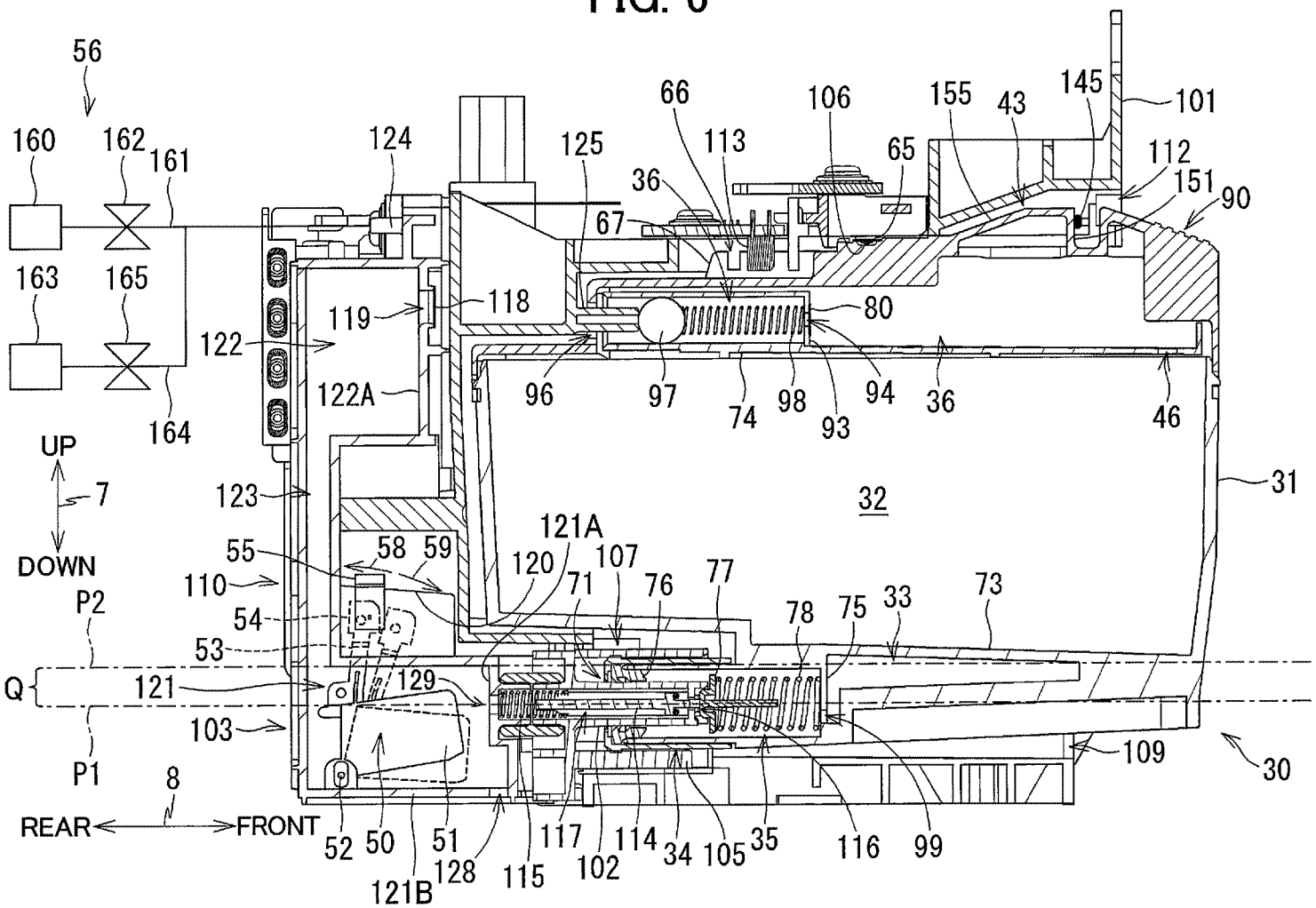
FIG. 6 is a vertical cross-sectional view of the cartridge attachment portion 110 and an ink cartridge 30 attached thereto according to the embodiment.

As illustrated in FIGS. 4 through 6, the cartridge attachment portion 110 includes a case 101, connecting portions 107, contacts 106, rods 125, attachment sensors 113, locking portions 145, tanks 103, and liquid level sensors 55, and switching portions 56. Four ink cartridges 30 corresponding to four colors of cyan, magenta, yellow, and black are detachably attachable to the cartridge attachment portion 110. One connecting portion 107, one set of four contacts 106, one rod 125, one attachment sensor 113, one tank 103, and one liquid level sensor 55 are provided corresponding to each of the four ink cartridges 30. Thus, in the present embodiment, four connecting portions 107, four sets of the four contacts 106, four rods 125, four attachment sensors 113, four tanks 103, and four liquid level sensors 55 are provided at the cartridge attachment portion 110. Note that the number of the ink cartridges 30 that can be accommodated in the cartridge attachment portion 110 is not limited to four, but may be any number.

<Case 101>

As illustrated in FIGS. 4 and 5, the case 101 constitutes a housing of the cartridge attachment portion 110. The case 101 has a box-like shape defining an internal space therein. Specifically, the case 101 has an inner top surface defining a top part of the internal space, an inner bottom surface defining a bottom part of the internal space, an inner end surface connecting the inner top surface and the inner bottom surface, and an opening 112 positioned opposite to the inner end surface in the front-rear direction 8. The opening 112 can be exposed to the front surface 14A of the casing 14 serving as a user-interface surface of the multifunction peripheral 10 that a user can face when operating the multifunction peripheral 10.

The ink cartridges 30 can be inserted into and extracted from the case 101 through the opening 85 of the casing 14 and the opening 112 of the cartridge attachment portion 110. In the case 101, the inner bottom surface is formed with four guide grooves 109 for guiding insertion and extraction of the ink cartridges 30. Movements of the ink cartridges 30 in the front-rear direction 8 in FIG. 4 are guided by the corresponding guide grooves 109 as lower end portions of the ink cartridges 30 are inserted into the corresponding guide grooves 109. The case 101 is also provided with three plates 104 that partition the internal space of the case 101 into four individual spaces each elongated in the up-down direction 7. Each of the four spaces partitioned by the plates 104 can receive one of the four ink cartridges 30.

Hereinafter, for simplifying explanation, in the following description and drawings, only one ink cartridge 30 is assumed to be accommodated in the case 101 of the cartridge attachment portion 110 unless otherwise specified.

<Connecting Portion 107>

As illustrated in FIG. 4, each connecting portion 107 includes an ink needle 102 and a guide portion 105.

The ink needle 102 is made of resin and has a generally tubular shape. The ink needle 102 is disposed at a lower end portion of the inner end surface of the case 101. Specifically, the ink needle 102 is disposed on the inner end surface of the case 101 at a position corresponding to an ink supply portion 34 (described later) of the ink cartridge 30 attached to the cartridge attachment portion 110. The ink needle 102 horizontally protrudes frontward from the inner end surface of the case 101.

The guide portion 105 has a cylindrical shape, and is disposed on the inner end surface to surround the ink needle 102. The guide portion 105 protrudes frontward from the inner end surface of the case 101. A protruding end of the guide portion 105 is open. Specifically, the ink needle 102 is positioned at a diametrical center of the guide portion 105. The guide portion 105 is so shaped that the ink supply portion 34 of the attached ink cartridge 30 is received in the guide portion 105.

In a state where the ink cartridge 30 is not attached to the cartridge attachment portion 110, the connecting portion 107 is not connected to the ink supply portion 34 of the ink cartridge 30. During the insertion process of the ink cartridge 30 into the cartridge attachment portion 110, i.e., in the course of action for bringing the ink cartridge 30 into an attached position to the cartridge attachment portion 110 (i.e., a position illustrated in FIG. 6), the ink supply portion 34 of the ink cartridge 30 enters into the guide portion 105. As the ink cartridge 30 is inserted into the cartridge attachment portion 110, the ink needle 102 enters into an ink supply port 71 formed in the ink supply portion 34. As a result, the connecting portion 107 is connected to the ink supply portion 34. Hence, ink stored in a storage chamber 33 formed in the ink cartridge 30 is allowed to flow into the tank 103 through an ink valve chamber 35 formed in the ink supply portion 34 and an internal space 117 (see FIG. 6) defined in the ink needle 102. Incidentally, the ink needle 102 may have a flat-shaped tip end or a pointed tip end.

As illustrated in FIG. 6, a valve 114 and a coil spring 115 are accommodated in the internal space 117 of the ink needle 102. The valve 114 is movable in the front-rear direction 8 to open and close an opening 116 formed in a protruding end portion of the ink needle 102. That is, the valve 114 opens and closes the internal space 117 of the ink needle 102. The coil spring 115 urges the valve 114 frontward. Accordingly, the valve 114 closes the opening 116 in a state where no external force is applied to the valve 114 (i.e., a state where the ink cartridge 30 is not attached to the cartridge attachment portion 110). Further, a front end portion of the valve 114 urged by the coil spring 115 protrudes frontward from the opening 116 in a state where no external force is applied to the valve 114. In the process of connecting the connecting portion 107 and the ink supply portion 34, the valve 114 opens the opening 116. An operation of the valve 114 opening the opening 116 will be described later in detail.

<Contacts 106>

As illustrated in FIG. 6, each of the four sets of the four contacts 106 is provided on the inner top surface of the case 101. Each of the four contacts 106 in each set protrudes downward from the inner top surface toward the internal space of the case 101. Although not illustrated in detail in the drawings, in each set, the four contacts 106 are arranged spaced apart from one another in the left-right direction 9.

Each of the four contacts 106 is arranged at a position corresponding to each one of four electrodes 65 (described later) of the ink cartridge 30. Each contact 106 is made of a material having electrical conductivity and resiliency. The contacts 106 are therefore upwardly resiliently deformable. The four sets of the four contacts 106 are provided each set for each one of the four ink cartridges 30 that can be accommodated in the case 101. Note that the number of the contacts 106 and the number of electrodes 65 may be any number.

Each contact 106 is electrically connected to the controller 130 (see FIG. 8) via an electrical circuit. When the respective contacts 106 are engaged with the corresponding electrodes 65 and electrically connected thereto, a voltage Vc is applied to the corresponding electrode 65, the corresponding electrode 65 is grounded, and electric power is supplied to the corresponding electrode 65. Due to establishment of the electrical connection between the contacts 106 and the corresponding electrodes 65, the controller 130 can access data stored in an IC of the ink cartridge 30. Outputs from the contacts 106 through the electrical circuits are inputted into the controller 130.

<Rod 125>

As illustrated in FIG. 6, each of the rods 125 is provided at a position above the ink needle 102 on the inner end surface of the case 101. The rod 125 protrudes frontward from the inner end surface of the case 101. The rod 125 has a cylindrical shape. The rod 125 is inserted into an air communication port 96 (described later) in a state where the ink cartridge 30 is attached to the cartridge attachment portion 110, that is, in a state where the ink cartridge 30 in in the attached position.

<Attachment Sensor 113>

As illustrated in FIG. 6, each of the attachment sensors 113 is also disposed at the inner top surface of the case 101. The attachment sensor 113 is configured to detect whether or not the ink cartridge 30 has been attached to the cartridge attachment portion 110. The attachment sensor 113 is disposed at a position frontward of the rod 125 but rearward of the contacts 106. In the present embodiment, the attachment sensor 113 includes a light-emitting portion and a light-receiving portion. The light-emitting portion of the attachment sensor 113 is positioned rightward or leftward relative to the light-receiving portion of the attachment sensor 113. The light-emitting portion of the attachment sensor 113 is arranged opposite to and spaced apart from the light-receiving portion of the attachment sensor 113 in the left-right direction 9. When the ink cartridge 30 has been attached to the cartridge attachment portion 110, a light-blocking plate 67 (described later) of the attached ink cartridge 30 is disposed between the light-emitting portion and the light-receiving portion of the attachment sensor 113. In other words, the light-emitting portion and the light-receiving portion of the attachment sensor 113 are arranged to oppose each other, with the light-blocking plate 67 of the attached ink cartridge 30 interposed therebetween.

The attachment sensor 113 is configured to output different detection signals depending on whether or not light emitted in the left-right direction 9 from the light-emitting portion of the attachment sensor 113 is received by the light-receiving portion of the attachment sensor 113. For example, the attachment sensor 113 outputs a low-level signal to the controller 130 (see FIG. 8) when the light-receiving portion of the attachment sensor 113 fails to receive the light emitted from the light-emitting portion of the attachment sensor 113 (that is, when an intensity of the light received at the light-receiving portion is less than a predetermined intensity). On the other hand, the attachment sensor 113 outputs a high-level signal to the controller 130 (see FIG. 8) when the light emitted from the light-emitting portion of the attachment sensor 113 is received by the light-receiving portion of the attachment sensor 113 (that is, when the intensity of the received light is equal to or greater than the predetermined intensity).

<Locking Portion 145>

As illustrated in FIG. 6, the locking portion 145 extends in the left-right direction 9 at a position in the vicinity of the inner top surface of the case 101 and in the vicinity of the opening 112. The locking portion 145 is a bar-like or rod-like member extending in the left-right direction 9. The locking portion 145 is, for example, a metal cylinder. The locking portion 145 has a left end fixed to a left side wall of the case 101 defining a left end of the case 101, and a right end fixed to a right side wall of the case 101 defining a right end of the case 101. The locking portion 145 extends in the left-right direction 9 over the four spaces in which the four ink cartridges 30 can be accommodated.

The locking portion 145 is configured to hold the ink cartridge 30 attached to the cartridge attachment portion 110 at the attached position. The ink cartridge 30 is engaged with the locking portion 145 in a state where the ink cartridge 30 is attached to the cartridge attachment portion 110. Accordingly, the locking portion 145 holds the ink cartridge 30 against urging forces of a coil spring 78 and a coil spring 98 of the ink cartridge 30 that push the ink cartridge 30 frontward.

<Tank 103>

As illustrated in FIGS. 4 through 6, the tanks 103 are provided at a rear portion of the case 101. Each of the tanks 103 has a generally box shape having therein a storage chamber 121, a buffer chamber 122, and a flow passage 123. The storage chamber 121 and the buffer chamber 122 are arranged in the up-down direction 7. Specifically, the buffer chamber 122 is disposed above the storage chamber 121. The storage chamber 121 and the buffer chamber 122 are in communication with each other through the flow passage 123. The flow passage 123 is positioned above the storage chamber 121 and extends in the up-down direction 7. The storage chamber 121 extends frontward further than the flow passage 123. The storage chamber 121, the buffer chamber 122, and the flow passage 123 are spaces defined by outer walls of the tank 103, respectively. The storage chamber 121 is substantially rectangular in cross-section taken along a horizontal plane. A cross-sectional area of the storage chamber 121 taken along the horizontal plane is greater than a cross-sectional area of the flow passage 123 taken along the horizontal plane.

The storage chamber 121 communicates with the internal space 117 of the ink needle 102 at a front end of the storage chamber 121. Specifically, the storage chamber 121 has a front wall 121A defining the front end of the storage chamber 121. The front wall 121A is formed with a communication port 129. The storage chamber 121 is in communication with the internal space 117 of the ink needle 102 through the communication port 129. With this configuration, ink flowing out of the ink cartridge 30 through the ink needle 102 is stored in the storage chamber 121.

In the tank 103, a convex portion 120 is formed at a position above the storage chamber 121 and frontward relative to the flow passage 123. An internal space of the convex portion 120 is in communication with the storage chamber 121. The convex portion 120 has side walls facing in the left-right direction 9 and each of the side walls is made of a translucent or light transmissive member. An arm 53 and a detected portion 54 of a pivoting member 50 (described later) are disposed in the convex portion 120.

The storage chamber 121 is in communication with an ink flow passage 126 (see FIG. 5) through a communication port 128. The storage chamber 121 has a bottom wall 121B defining a bottom end of the storage chamber 121. The communication port 128 is formed in the bottom wall 121B of the storage chamber 121. The communication port 128 is positioned downward relative to the connecting portion 107 in a direction of gravity. Further, the communication port 128 is positioned downward relative to the communication port 129 in the direction of gravity.

The ink flow passage 126 extends upward from the storage chamber 121 and continuous to an ink outflow port 127. Corresponding one of the ink tubes 20 is connected to the ink outflow port 127. This configuration allows the ink stored in the storage chamber 121 to flow out of the storage chamber 121 through the communication port 128 to be supplied to the recording head 21 through the ink flow passage 126 and the ink tube 20.

The buffer chamber 122 is in communication with an air communication port 124 provided at an upper portion of the tank 103. Specifically, the buffer chamber 122 has a front wall 122A formed with a through-hole 119 (see FIG. 6). The through-hole 119 is sealed with a semi-permeable membrane 118. The buffer chamber 122 is in communication with the air communication port 124 through the through-hole 119. The air communication port 124 is open to an outside through the switching portion 56 (see FIGS. 6 and 8, described later). With this configuration, the storage chamber 121 and the buffer chamber 122 can be open to an atmosphere. That is, the air communication port 124 allows the storage chamber 121 and the buffer chamber 122 to be in communication with the atmosphere. In the present embodiment, two air communication ports 124, namely, a first air communication port 124A and a second communication portion 124B, are provided in the cartridge attachment portion 110 as illustrated in FIG. 5.

In FIG. 5, a film forming a rear surface of each tank 103 is omitted. Each of the storage chamber 121, the buffer chamber 122, the flow passage 123, and the ink flow passage 126 has a rear end sealed with the film.

<Pivoting Member 50>

As illustrated in FIG. 6, the pivoting member 50 is disposed in the storage chamber 121 of each tank 103. The pivoting member 50 is supported by a supporting member (not illustrated) disposed in the storage chamber 121 so as to be pivotally movable in directions of arrows 58 and 59. The pivoting member 50 may be supported by a member other than the supporting member. For example, the pivoting member 50 may be supported by walls of the case 101 that partitions the storage chamber 121.

The pivoting member 50 includes a float 51, a shaft 52, the arm 53, and the detected portion 54. The float 51 constitutes a lower portion of the pivoting member 50. The float 51 is made of a material having a specific gravity smaller than that of the ink stored in the storage chamber 121. The shaft 52 protrudes from left and right surfaces of the float 51 in the left-right direction 9. The protruding ends of the shaft 52 are inserted into holes formed in the support member. With this configuration, the pivoting member 50 is supported by the supporting member so as to be pivotally movable about the shaft 52.

The arm 53 protrudes substantially upward from the float 51. The detected portion 54 is provided at a protruding tip portion of the arm 53. The arm 53 and the detected portion 54 are located in the internal space of the convex portion 120. The detected portion 54 has a plate shape extending in the up-down direction 7 and the front-rear direction 8. The detected portion 54 is made of a material that blocks light emitted from a light-emitting portion of the corresponding liquid level sensor 55 (described later, see FIG. 8).

When a liquid level of the ink stored in the storage chamber 121 is higher than a position P1 at the connecting portion 107 in the up-down direction 7, in other words, when a liquid level of the ink stored in the storage chamber 33 of the ink cartridge 30 is higher than the position P1 at the ink supply portion 34 in the up-down direction 7, the pivoting member 50 pivotally moves in the direction of the arrow 58 due to buoyancy acting on the float 51. As a result, the pivoting member 50 is positioned at a detection position in which a part of the pivoting member 50 is indicated by a solid line in FIG. 6.

In the present embodiment, the position P1 is the same height as the center of an axis of the ink needle 102 and is also the same height as the center of the ink supply port 71. However, the position P1 is not limited to this position as long as the position P1 is the same height as the connecting portion 107 and the ink supply portion 34 in the up-down direction 7. For example, the position P1 may be the same height as an upper end or a lower end of the ink needle 102, or may be the same height as an upper end or a lower end of the ink supply port 71.

On the other hand, when the ink stored in the storage chamber 121 and in the ink valve chamber 35 is consumed and the liquid level of the ink stored in the storage chamber 121 is lowered to a position equal to or lower than the position P1 in the up-down direction 7, the pivoting member 50 follows the liquid level of the ink stored in the storage chamber 121 and pivotally moves in the direction of the arrow 59. As a result, the pivoting member 50 is positioned at a non-detection position indicated by a broken line in FIG. 6. That is, the pivoting member 50 changes its posture when the liquid level of the ink stored in the storage chamber 121 reaches the same position as the connecting portion 107 in the up-down direction 7.

<Liquid Level Sensor 55>

The liquid level sensor 55 (see FIGS. 6 and 8) is provided for detecting the change in posture of the pivoting member 50 provided with the detected portion 54. In the present embodiment, the liquid level sensor 55 includes a light-emitting portion and a light-receiving portion. The light-emitting portion and the light-receiving portion of the liquid level sensor 55 are arranged spaced apart from each other in the left-right direction 9, with the convex portion 120 of the tank 103 interposed therebetween. The light-emitting portion of the liquid level sensor 55 is disposed at one of a right side and a left side relative to the convex portion 120, while the light-receiving portion of the liquid level sensor 55 is disposed at the other of the right side and the left side relative to the convex portion 120. A path of light outputted from the light-emitting portion of the liquid level sensor 55 coincides with the left-right direction 9. When the pivoting member 50 is positioned at the detection position, the detected portion 54 of the pivoting member 50 is positioned between the light-emitting portion and the light-receiving portion of the liquid level sensor 55.

The liquid level sensor 55 is configured to output detection signals different from each other depending on whether or not the light outputted from the light-emitting portion of the liquid level sensor 55 is received by the light-receiving portion of the liquid level sensor 55. For example, the liquid level sensor 55 outputs a low-level signal (that is, a signal whose signal level is less than a threshold level) to the controller 130 (see FIG. 8) when the light-receiving portion of the liquid level sensor 55 fails to receive the light outputted from the light-emitting portion of the liquid level sensor 55 (that is, an intensity of the light received at the light-receiving portion of the liquid level sensor 55 is less than a predetermined intensity). On the other hand, the liquid level sensor 55 outputs a high-level signal (that is, a signal whose signal level is equal to or higher than the threshold level) to the controller 130 when the light-receiving portion of the liquid level sensor 55 receives the light outputted from the light-emitting portion of the liquid level sensor 55 (that is, the intensity of the light received at the light-receiving portion is equal to or higher than the predetermined intensity).

As illustrated in FIG. 6, when the pivoting member 50 is at the detection position, the detected portion 54 is positioned between the light-emitting portion and the light-receiving portion of the liquid level sensor 55. Thus, when the liquid level of the ink stored in the storage chamber 121 of the tank 103 (in other words, the liquid level of the ink stored in the storage chamber 33 of the ink cartridge 30) is higher than the position P1 in the up-down direction 7, the light-receiving portion of the liquid level sensor 55 fails to receive the light outputted from the light-emitting portion of the liquid level sensor 55. Accordingly, the liquid level sensor 55 outputs the low-level signal to the controller 130.

On the other hand, when the pivoting member 50 is at the non-detection position, the detected portion 54 is retracted from a position between the light-emitting portion and the light-receiving portion of the liquid level sensor 55. Thus, when the liquid level of the ink stored in the storage chamber 121 of the tank 103 (in other words, the liquid level of the ink stored in the storage chamber 33 of the ink cartridge 30) is equal to or lower than the position P1 in the up-down direction 7, the light-receiving portion of the liquid level sensor 55 receives the light outputted from the light-emitting portion of the liquid level sensor 55. Accordingly, the liquid level sensor 55 outputs the high-level signal to the controller 130.

<Switching Portion 56>

The switching portion 56 is in communication with the air communication port 124 provided at the tank 103 through a tube (not illustrated). That is, one end of the tube is in communication with the air communication port 124 while the other end of the tube is in communication with the switching portion 56.

Note that, in the present embodiment, two switching portions 56 are provided in one-to-one correspondence with the two air communication ports 124.

As described above, the two air communication ports 124 include the first air communication port 124A and the second air communication port 124B. The air communication port 124A is configured to communicate with the storage chamber 121 of one of the four tanks 103, that is, the tank 103 corresponding to the black ink cartridges 30. The air communication port 124B is configured to communicate with the storage chambers 121 of the remaining three tanks 103 respectively corresponding to the cyan, magenta, and yellow ink cartridges 30. One of the two switching portions 56 is in communication with the air communication port 124A. The other of the two switching portions 56 is in communication with the air communication port 124B.

Each of the switching portions 56 includes a first semi-permeable membrane 160, a first air passage 161, a first valve 162, a second semi-permeable membrane 163, a second air passage 164, and a second valve 165.

The first air passage 161 is sealed by the first semi-permeable membrane 160. The first valve 162 is configured to open and close the first air passage 161. The second air passage 164 is sealed by the second semi-permeable membrane 163. The second valve 165 is configured to open and close the second air passage 164. The first semi-permeable membrane 160 has a Gurley number different from that of the second semi-permeable membrane 163. Specifically, the Gurley number of the first semi-permeable membrane 160 is greater than that of the second semi-permeable membrane 163. In other words, a time required for a prescribed volume of air to pass through the first semi-permeable membrane 160 per unit area at a prescribed pressure is longer than a time required for the prescribed volume of air to pass through the second semi-permeable membrane 163 per unit area at the prescribed pressure.

The switching portion 56 is configured to be switched between a first state and a second state when the first valve 162 and the second valve 165 are controlled to open and close the first air passage 161 and the second air passage 164, respectively. When the switching portion 56 is at the first state, the first air passage 161 is open and the second air passage 164 is closed. When the switching portion 56 is at the second state, the first air passage 161 is closed and the second air passage 164 is open. By switching the switching portion 56 between the first state and the second state, a passage resistance value at the corresponding tank 103 is changed since the tank 103 is open to an atmosphere through the air communication port 124.

A passage resistance value at a passage through which the tank 103 is open to the atmosphere when the switching portion 56 is at the first state is greater than a passage resistance value at the passage through which the tank 103 is open to the atmosphere when the switching portion 56 is at the second state.

In other words, the passage resistance value at the air communication port 124 when the switching portion 56 is at the first state is greater than the passage resistance value at the air communication port 124 when the switching portion 56 is at the second state.

Incidentally, the number of the switching portions 56 and the number of the air communication ports 124 are not limited to the above numbers as long as the passage resistance value at the corresponding tank 103 can be changed.

For example, the cartridge attachment portion 110 may be provided with a single air communication port 124, and the four tanks 103 may merge with and communicate with the single air communication port 124. In this case, a single switching portion 56 that communicates with the single air communication port 124 merged with the four tanks 103 may be provided. By switching the single switching portion 56 between the first state and the second state, the passage resistance values at all the four tanks 103 may be changed.

Alternatively, the cartridge attachment portion 110 may be provided with four air communication ports 124 in one-to-one correspondence with the four tanks 103, and four switching portions 56 may be provided in one-to-one correspondence with the four air communication ports 124. By operating each of the switching portions 56, the passage resistance values at the four respective tanks 103 may be individually changed.

<Ink Cartridge 30>

Figure 7:
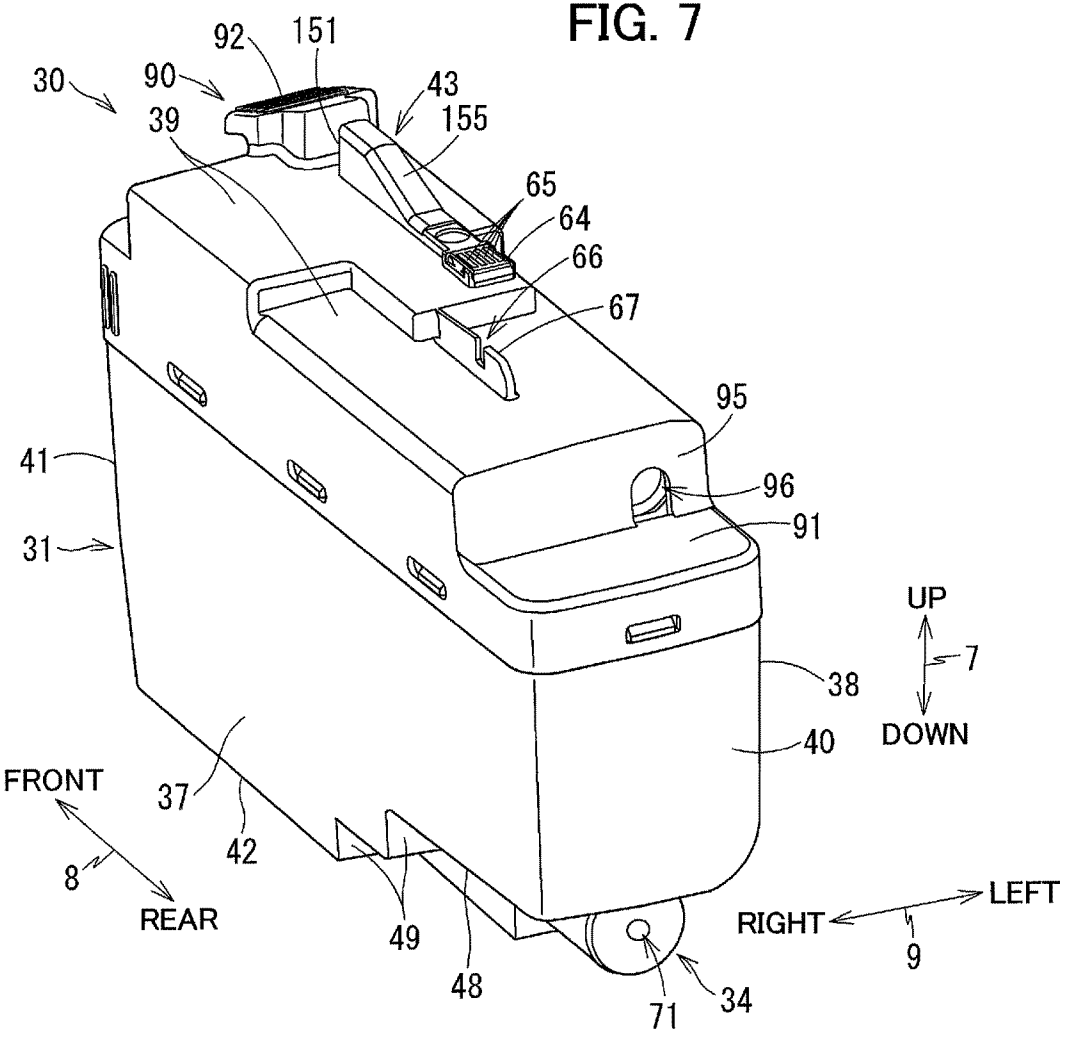
FIG. 7 is a perspective view of the ink cartridge 30 as viewed from a rear side thereof according to the embodiment.

The ink cartridge 30 illustrated in FIGS. 6 and 7 is a container for storing ink therein. A posture of the ink cartridge 30 illustrated in FIGS. 6 and 7 is an operable posture of the ink cartridge 30, that is, a posture of the ink cartridge 30 when the ink cartridge 30 is capable of being used in the multifunction peripheral 10. As described above, in the embodiment, four ink cartridges 30 corresponding to respective four colors of cyan, magenta, yellow, and black can be attached to the cartridge attachment section 110.

As illustrated in FIGS. 6 and 7, the ink cartridge 30 has a cartridge casing 31 that is substantially rectangular parallelepiped. The cartridge casing 31 includes a rear wall 40, a front wall 41, a top wall 39, a bottom wall 42, a right side wall 37, and a left side wall 38.

The cartridge casing 31 as a whole has a generally flattened shape so that a dimension of the cartridge casing 31 in the left-right direction 9 is small, and a dimension of the cartridge casing 31 in the up-down direction 7 and a dimension of the cartridge casing 31 in the left-right direction 9 are greater than the dimension of the cartridge casing 31 in the left-right direction 9. At least the front wall 41 of the cartridge casing 31 has translucency so that the liquid level of the ink stored in a storage chamber 32 (described later) and the storage chamber 33 can be visually recognized from an outside of the cartridge casing 31.

The cartridge casing 31 further includes a subordinate bottom wall 48 and a stepped wall 49. The subordinate bottom wall 48 is positioned upward relative to the bottom wall 42 and extends frontward continuously from a lower end of the rear wall 40. The stepped wall 49 connects the bottom wall 42 to the subordinate bottom wall 48. The ink supply portion 34 extends rearward from the stepped wall 49 at a position downward relative to the subordinate bottom wall 48 and upward relative to the bottom wall 42.

A convex portion 43 is provided at an outer surface of the top wall 39. The convex portion 43 protrudes upward from the outer surface of the top wall 39. The convex portion 43 extends in the front-rear direction 8. The convex portion 43 has a lock surface 151 facing frontward. The lock surface 151 is positioned upward relative to the top wall 39. The lock surface 151 facing frontward is in contact with the locking portion 145 in a state where the ink cartridge 30 is attached to the cartridge attachment portion 110. The lock surface 151 comes into contact with the locking portion 145 while pushing the locking portion 145 frontward, so that the ink cartridge 30 is held in the cartridge attachment portion 110 against the urging forces of the coil springs 78 and 98.

The convex portion 43 also has an inclined surface 155. The inclined surface 155 is positioned rearward relative to the lock surface 151. During an attachment process of the ink cartridge 30 to the cartridge attachment portion 110, the locking portion 145 is guided by the inclined surface 155. As the locking portion 145 moves along the inclined surface 155, the locking portion 145 is guided to a position capable of contacting the lock surface 151.

An operation portion 90 is disposed frontward relative to the lock surface 151 of the top wall 39. The operation portion 90 has an operation surface 92. When the operation surface 92 is pushed downward in a state where the ink cartridge 30 is attached to the cartridge attachment portion 110, the ink cartridge 30 pivotally moves. In accordance with pivotal movement of the ink cartridge 30, the lock surface 151 moves downward. Hence, the lock surface 151 is positioned further downward than the locking portion 145. As a result, the ink cartridge 30 can be extracted from the cartridge attachment portion 110.

The light-blocking plate 67 is provided at the outer surface of the top wall 39. The light-blocking plate 67 protrudes upward from the outer surface of the top wall 39. The light-blocking plate 67 extends in the front-rear direction 8. The light-blocking plate 67 is disposed rearward relative to the convex portion 43.

The light-blocking plate 67 is disposed between the light-emitting portion and the light-receiving portion of the attachment sensor 113 in a state where the ink cartridge 30 is attached to the cartridge attachment portion 110. Hence, the light-blocking plate 67 is configured to block the light emitted from the attachment sensor 113 and traveling in the left-right direction 9.

More specifically, when the light emitted from the light-emitting portion of the attachment sensor 113 is incident on the light-blocking plate 67 before the light arrives at the light-receiving portion of the attachment sensor 113, the intensity of the light received by the light-receiving portion of the attachment sensor 113 is less than a predetermined intensity, for example, zero. Note that the light-blocking plate 67 may completely block the light traveling in the left-right direction 9, or may partially attenuate the light. Alternatively, the light-blocking plate 67 may refract the light to change a traveling direction thereof, or may fully reflect the light.

In the present embodiment, a notch 66 is formed in the light-blocking plate 67. The notch 66 is a space that is recessed downward from an upper edge of the light-blocking plate 67, and extends in the front-rear direction 8. When the notch 66 formed in the light-blocking plate 67 overlaps with an optical path of the light outputted from the light-emitting portion of the attachment sensor 113 while the ink cartridge 30 is attached to the cartridge attachment portion 110, the light emitted from the light-emitting portion of the attachment sensor 113 passes through the notch 66 and is therefore not blocked by the light-blocking plate 67. Accordingly, the light emitted from the light-emitting portion of the attachment sensor 113 reaches the light-receiving portion of the attachment sensor 113. Types of the ink cartridge 30, that is, types of ink stored in the ink cartridge 30, initial amounts of the ink stored in the ink cartridge 30, and the like, can be determined on a basis of whether or not the notch 66 is formed in the light-blocking plate 67. In the present embodiment, the notch 66 is positioned offset from the optical path in a state where the ink cartridge 30 is attached to the cartridge attachment portion 110, as illustrated in FIG. 6.

An IC board 64 is provided at the outer surface of the top wall 39. The IC board 64 is positioned between the light-blocking plate 67 and the convex portion 43 in the front-rear direction 8. The IC board 64 is electrically connected to corresponding one set of four contacts 106 in a state where the ink cartridge 30 is attached to the cartridge attachment portion 110.

The IC board 64 includes a substrate, an IC (not illustrated), and four electrodes 65. The IC and the four electrodes 65 are mounted on the substrate. The four electrodes 65 are arrayed in the left-right direction 9. The IC is an integrated circuit. The IC readably stores data indicative of information on the ink cartridge 30, such as a lot number, a manufacturing date, a color of ink, and the like.

Each of the four electrodes 65 is electrically connected to the IC. The four electrodes 65 each extend in the front-rear direction 8 and are arranged spaced apart from one another in the left-right direction 9. Each electrode 65 is exposed to an outside to allow electrical access to an upper surface of the IC board 64.

The outer surface of the top wall 39 includes a subordinate top surface 91 at a rear end portion thereof. A stepped surface 95 extends upward from a front end of the subordinate top surface 91. The stepped surface 95 is a surface facing rearward. The stepped surface 95 is formed with an open end of the air communication port 96 through which the storage chamber 32 is in communication with an atmosphere. In the attachment process of the ink cartridge 30 into the cartridge attachment portion 110, as illustrated in FIG. 6, the rod 125 enters an air valve chamber 36 (described later) through the air communication port 96. As the rod 125 enters the air valve chamber 36 through the air communication port 96, the rod 125 moves a valve 97 (described later) that seals the air communication port 96 frontward against the urging force of the coil spring 98. When the valve 97 is moved frontward and separated from the air communication port 96, the storage chamber 32 is open to an atmosphere.

As illustrated in FIG. 6, the storage chamber 32, the storage chamber 33, the ink valve chamber 35, and the air valve chamber 36 are provided within the cartridge casing 31. The storage chamber 32, the storage chamber 33, and the ink valve chamber 35 are configured to store ink therein. The air valve chamber 36 is configured to communicate with an atmosphere.

The storage chamber 32 and the storage chamber 33 are separated from each other in the up-down direction 7 by a partition wall 73. The storage chamber 32 and the storage chamber 33 are in communication with each other through a through-hole (not illustrated) formed in the partition wall 73.

The storage chamber 32 and the air valve chamber 36 are separated from each other in the up-down direction 7 by a partition wall 74. The storage chamber 32 and the air valve chamber 36 are in communication with each other through a through-hole 46 formed in the partition wall 74.

The storage chamber 33 and the ink valve chamber 35 are separated from each other in the front-rear direction 8 by a partition wall 75. The storage chamber 33 and the ink valve chamber 35 are in communication with each other through a through-hole 99 formed in a lower end of the partition wall 75.

Accordingly, the storage chamber 32 is a space defined by each inner surface of outer walls of the cartridge casing 31, an upper surface of the partition wall 73, and a lower surface of the partition wall 74.

Further, the storage chamber 33 is a space defined by each inner surface of the outer walls of the cartridge casing 31, a lower surface of the partition wall 73, and a front surface of the partition wall 75.

The valve 97 and the coil spring 98 are accommodated in the air valve chamber 36. The air valve chamber 36 is in communication with an outside through the air communication port 96 whose open end is formed in the stepped surface 95. The valve 97 is movable between a closed position and an open position. At the closed position, the valve 97 seals the air communication port 96. At the open position, the valve 97 is separated from the air communication port 96. The coil spring 98 is disposed in the air valve chamber 36 so as to be extensible and contractible in the front-rear direction 8. The coil spring 98 urges the valve 97 in a direction such that the valve 97 contacts the air communication port 96. That is, the coil spring 98 urges the valve 97 rearward.

The air valve chamber 36 has a wall 93 that partitions the air valve chamber 36 into a front portion and a rear portion of the air valve chamber 36. The wall 93 is formed with a through-hole 94. The through-hole 94 is sealed with a semi-permeable membrane 80. The storage chamber 32 is in communication with the air valve chamber 36 through the through-hole 46.

The ink supply portion 34 protrudes rearward from the stepped wall 49. The ink supply portion 34 has a cylindrical outer shape. The ink supply portion 34 has an inner space serving as the ink valve chamber 35. The ink supply portion 34 has a rear end that is open to an outside of the ink cartridge 30 through the ink supply port 71. A seal member 76 is provided in the ink supply portion 34 at its rear end portion. The ink supply portion 34 has a front end that is in communication with the storage chamber 33 through the through-hole 99 formed in a lower end thereof as described above. That is, the ink supply portion 34 is in communication with the storage chamber 33 at its lower end.

A valve 77 and the coil spring 78 are accommodated in the ink valve chamber 35. The valve 77 moves in the front-rear direction 8 to open and close the ink supply port 71 penetrating a center portion of the seal member 76. The coil spring 78 urges the valve 77 rearward. Accordingly, the valve 77 closes the ink supply port 71 formed in the seal member 76 in a state where no external force is applied to the valve 77.

The seal member 76 is a disk-shaped member in which a through-hole is formed at its center portion. The seal member 76 is made of, for example, an elastic material such as rubber or elastomer. The center portion of the seal member 76 is penetrated in the front-rear direction 8 to form a cylindrical inner peripheral surface. The inner peripheral surface of the seal member 76 serves as the ink supply port 71. The ink supply port 71 has an inner diameter slightly smaller than an outer diameter of the ink needle 102.

When the ink cartridge 30 is attached to the cartridge attachment portion 110 in a state where the valve 77 closes the ink supply port 71 and the valve 114 closes the opening 116 of the ink needle 102, the ink needle 102 enters the ink valve chamber 35 through the ink supply port 71. That is, the connecting portion 107 and the ink supply portion 34 are connected to each other. At this time, the outer peripheral surface of the ink needle 102 liquid-tightly contacts the inner peripheral surface of the seal member 76 that defines the ink supply port 71, while elastically deforming the seal member 76. As the tip end of the ink needle 102 passes through the seal member 76 to further enter the ink valve chamber 35, the tip end of the ink needle 102 abuts on the valve 77. When the ink cartridge 30 is further inserted into the cartridge attachment portion 110, the ink needle 102 moves the valve 77 frontward against the urging force of the coil spring 78. As a result, the ink supply port 71 is open.

Further, while the tip end of the ink needle 102 abuts on the valve 77, the valve 77 abuts on the valve 114 from a front side thereof and pushes the valve 114 rearward. Hence, the valve 114 moves rearward against the urging force of the coil spring 115. Thus, the opening 116 is open. As a result, the ink stored in the ink valve chamber 35 can flow into the storage chamber 121 of the tank 103 through the internal space 117 of the ink needle 102. As described above, the ink stored in the storage chamber 32, the storage chamber 33, and the ink valve chamber 35 is supplied to the storage chamber 121 of the tank 103 through the ink supply portion 34.

<Control Portion 130>

Figure 8:
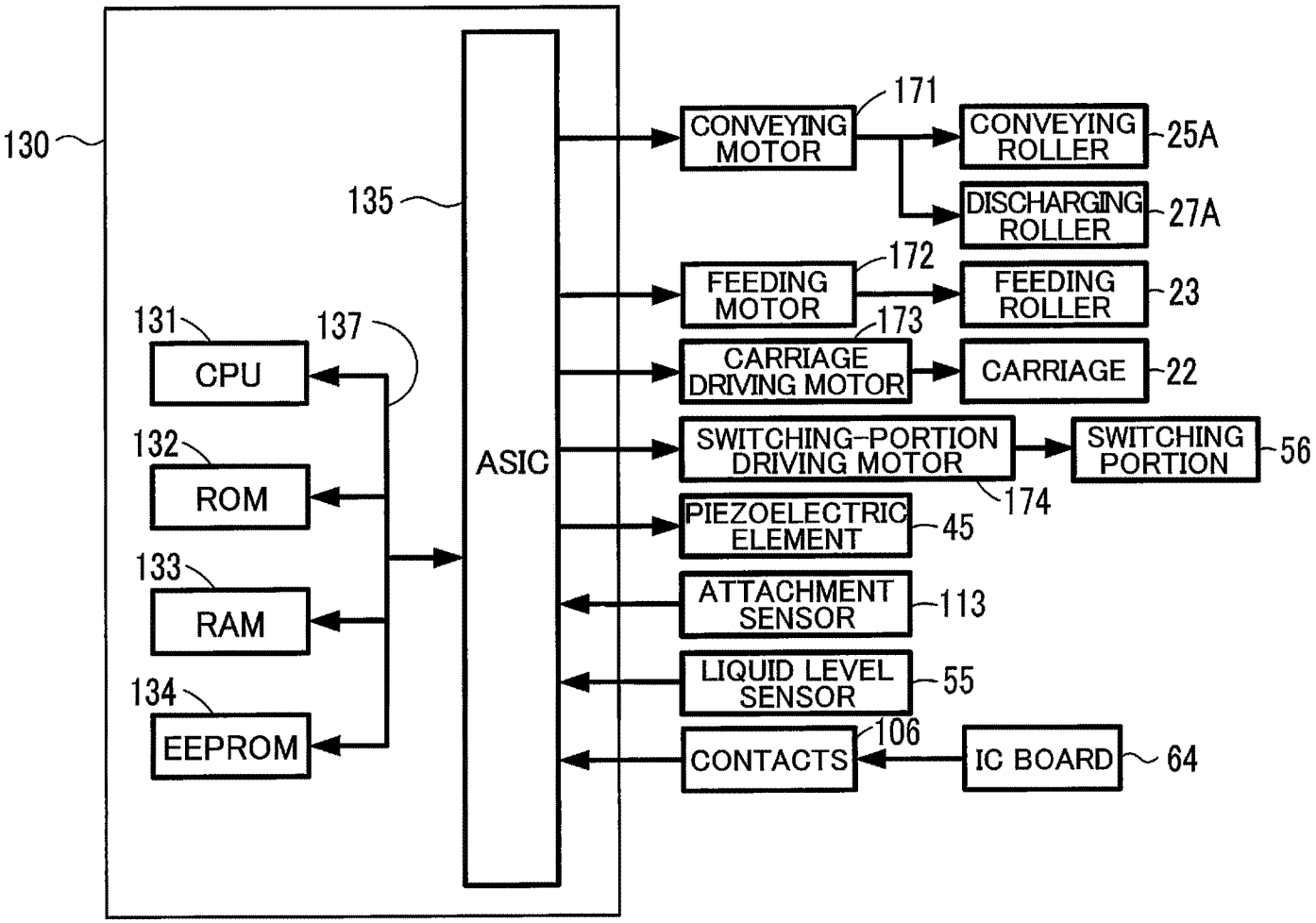
FIG. 8 is a block diagram illustrating a configuration of a controller 130 of the multifunction peripheral 10 according to the embodiment.

Next, a schematic configuration of the controller 130 will be described with reference to FIG. 8.

The multifunction peripheral 10 includes the controller 130. The controller 130 is configured to control overall operations of the multifunction peripheral 10. The controller 130 includes a CPU 131, a ROM 132, a RAM 133, an EEPROM 134, an ASIC 135, and an internal bus 137 that connects these components to one another.

The ROM 132 stores programs and the like by which the CPU 131 can control various operations including an image recording control operation. The RAM 133 is used as a storage area for temporarily storing data, signals, and the like used when the CPU 131 executes the programs. The EEPROM 134 stores settings, flags, and the like that must be preserved after the multifunction peripheral 10 has been turned off.

The conveying motor 171, the feeding motor 172, and the carriage driving motor 173 are connected to the ASIC 135. Further, a switching-portion driving motor 174 for driving the switching portion 56 is also connected to the ASIC 135. The ASIC 135 includes drive circuits for controlling these motors. When the CPU 131 inputs a drive signal for rotating a predetermined motor into a drive circuit corresponding to the predetermined motor, a drive current corresponding to the drive signal is outputted from the drive circuit to the corresponding motor. As a result, the corresponding motor rotates. That is, the controller 130 controls driving of the motors 171, 172, 173, and 174.

Further, signals outputted from the attachment sensor 113 are inputted into the ASIC 135. When a low level signal is inputted into the ASIC 135 from the attachment sensor 113, the controller 130 determines that the ink cartridge 30 has been attached to the cartridge attachment portion 110. On the other hand, when a high level signal is inputted into the ASIC 135 from the attachment sensor 113, the controller 130 determines that the ink cartridge 30 has not been attached to the cartridge attachment portion 110.

Further, signals outputted from the liquid level sensor 55 are inputted into the ASIC 135. When a low level signal is inputted into the ASIC 135 from the liquid level sensor 55, the controller 130 determines that the liquid level of the ink stored in the storage chamber 121 of the tank 103 and the liquid level of the ink stored in the storage chamber 33 of the ink cartridge 30 are positioned higher than the position P1 in the up-down direction 7. On the other hand, when a high level signal is inputted into the ASIC 135 from the liquid level sensor 55, the controller 130 determines that the liquid level of the ink stored in the storage chamber 121 of the tank 103 and the liquid level of the ink stored in the storage chamber 33 of the ink cartridge 30 are positioned lower than or equal to the position P1 in the up-down direction 7.

When the controller 130 determines that the liquid level of the ink is positioned lower than or equal to the position P1 in the up-down direction 7, the controller 130 notifies the user that the ink cartridge 30 needs to be replaced, by displaying a warning message on a display, turning on an LED, emitting a warning sound, or the like.

Note that the controller 130 determines, with respect to each of the four ink cartridges 30, the position in the up-down direction 7 of the liquid level of the ink stored in the storage chamber 33. Further, the controller 130 determines, with respect to each of the four tanks 103 corresponding to the four ink cartridges 30, the position in the up-down direction 7 of the liquid level of the ink stored in the storage chamber 121.

The piezoelectric element 45 is also connected to the ASIC 135. The piezoelectric element 45 operates when the controller 130 supplies electric power to the piezoelectric element 45 via a drive circuit (not illustrated). The controller 130 controls power supply to the piezoelectric element 45 to selectively eject ink droplets through the plurality of nozzles 29.

When recording an image on the sheet 12, the controller 130 controls the conveying motor 171 to execute an intermittent conveying process of alternately repeating conveyance of the sheet 12 by predetermined line feeds and stop of the conveyance with the conveying rollers 25 and the discharging rollers 27.

The controller 130 executes an ejection process while the sheet 12 is stopped in the intermittent conveying process. The ejection process is a process of controlling the power supply to the piezoelectric element 45 to eject ink droplets from the nozzles 29 while moving the carriage 22 in the left-right direction 9. That is, when the controller 130 executes the ejection process, ink droplets are ejected from the nozzles 29 during a single pass (hereinafter also referred to as "one pass") that the carriage 22 moves from one end of a printing range to the other end of the printing range. Hence, one pass worth of an image is recorded on the sheet 12.

By alternately performing the intermittent conveying process and the ejection process, an image can be recorded in the entire image recordable region of the sheet 12. An image recording process is a process of recording an image on the sheet 12 by alternately performing the intermittent conveying process and the ejection process.

The controller 130 executes a series of processes of recording an image on the sheet 12 by controlling each of the motors 171, 172, and 173, and the piezoelectric element 45 based on the signals outputted from the sensors 55 and 113 to the controller 130. The series of processes includes feeding of the sheet 12 supported by the feeding tray 15 to the conveyance path 17 with the feeding roller 23, conveying of the sheet 12 fed to the conveyance path 17 in the conveying direction with the conveying rollers 25 and the discharging rollers 27, recording of an image on the sheet 12 conveyed through the conveyance path 17 by executing the intermittent conveying process and the ejection process, and discharging of the sheet 12 on which the image is recorded to the discharging tray 16 with the discharging rollers 27.

<Passage Resistance>

Here, in an attached state of the ink cartridge 30 to the cartridge attachment portion 110, a passage resistance value at which air flows through a passage extending from the through-hole 46 that opens to the storage chamber 32 to the air communication port 96 is defined as a passage resistance value R1A. Further, in the attached state of the ink cartridge 30 to the cartridge attachment portion 110, a passage resistance value at which ink flows through the ink supply portion 34 is defined as a passage resistance value R1B. Further, a sum of the passage resistance value R1A and the passage resistance value R1B is defined as a first passage resistance value R1. Further, in the attached state of the ink cartridge 30 to the cartridge attachment portion 110, a passage resistance value at which air flows through a passage in the tank 103 extending from the through-hole 119 formed in the front wall 122A of the buffer chamber 122 to the air communication port 124 is defined as a second passage resistance value R2.

In addition, in the tank 103, a region spanning between a horizontal plane at a position P2 (see FIG. 6) and a horizontal plane at the position P1 is defined as a region Q. The position P2 is a position of a horizontal plane including a boundary between the storage chamber 121 and the flow passage 123 in the up-down direction 7. The storage chambers 32 and 33 of the ink cartridge 30 have a space contained in the region Q, and this space is defined as a first space. The first space has an average cross-sectional area that is an average value of a plurality of cross-sectional areas taken along a plurality of horizontal planes positioned in the first space in the up-down direction 7. The average cross-sectional area of the first space is defined as a first cross-sectional area S1. The storage chamber 121 of the tank 103 has a space contained in the region Q, and this space is defined as a second space. The second space has an average cross-sectional area that is an average value of a plurality of cross-sectional areas taken along a plurality of horizontal planes positioned in the second space in the up-down direction 7. The average cross-sectional area of the second space is defined as a second cross-sectional area S2. Further, a cross-sectional area ratio A is defined which is obtained by dividing the first average cross-sectional area S1 by the second average cross-sectional area S2. Here, the second passage resistance value R2 is greater than a product A×R1 obtained by multiplying the first average passage resistance value R1 by the cross-sectional area ratio A. In other words, an inequality of "R2>A×R1" is met.

<Operations of Switching Portion 56>

First, a process executed by the controller 130 for switching the switching portion 56 between the first state and the second state when the ink cartridge 30 attached to the cartridge attachment portion 110 is detached therefrom and a new ink cartridge 30 is attached to the cartridge attachment portion 110 will be described while referring to the flowchart in FIG. 9. Here, the process executed by the controller 130 will be described based on a case where the ink cartridge 30 corresponding to a color of black is replaced with a new cartridge, as an example. In a case where any of the ink cartridges 30 corresponding to colors of cyan, magenta, and yellow is replaced with a new cartridge, the controller 130 executes a process equivalent to that executed at the time of replacement of the black ink cartridge 30.

The controller 130 determines that the ink cartridge 30 has been detached from the cartridge attachment portion 110 when the signal inputted into the controller 130 from the attachment sensor 113 has switched from a low level signal to a high level signal. On the other hand, the controller 130 determines that the ink cartridge 30 has been attached to the cartridge attachment portion 110 when the signal inputted into the controller 130 from the attachment sensor 113 has switched from a high level signal to a low level signal.

The controller 130 maintains the switching portion 56 at the first state if no specific command has been received. Incidentally, by default, the switching portion 56 may be either at the first state or at the second state. The controller 130 operates the switching portion 56 subject to a condition that the signal inputted into the controller 130 from the attachment sensor 113 has switched from a high level signal to a low level signal after switched from a low level signal to a high level signal. That is, the controller 130 operates the switching portion 56 subject to receipt of a signal indicative of a change from non-attachment to attachment of the ink cartridge 30 to the cartridge attachment portion 110 from the attachment sensor 113. Specifically, at this time, the switching portion 56 is switched from the first state to the second state.

Figure 9:
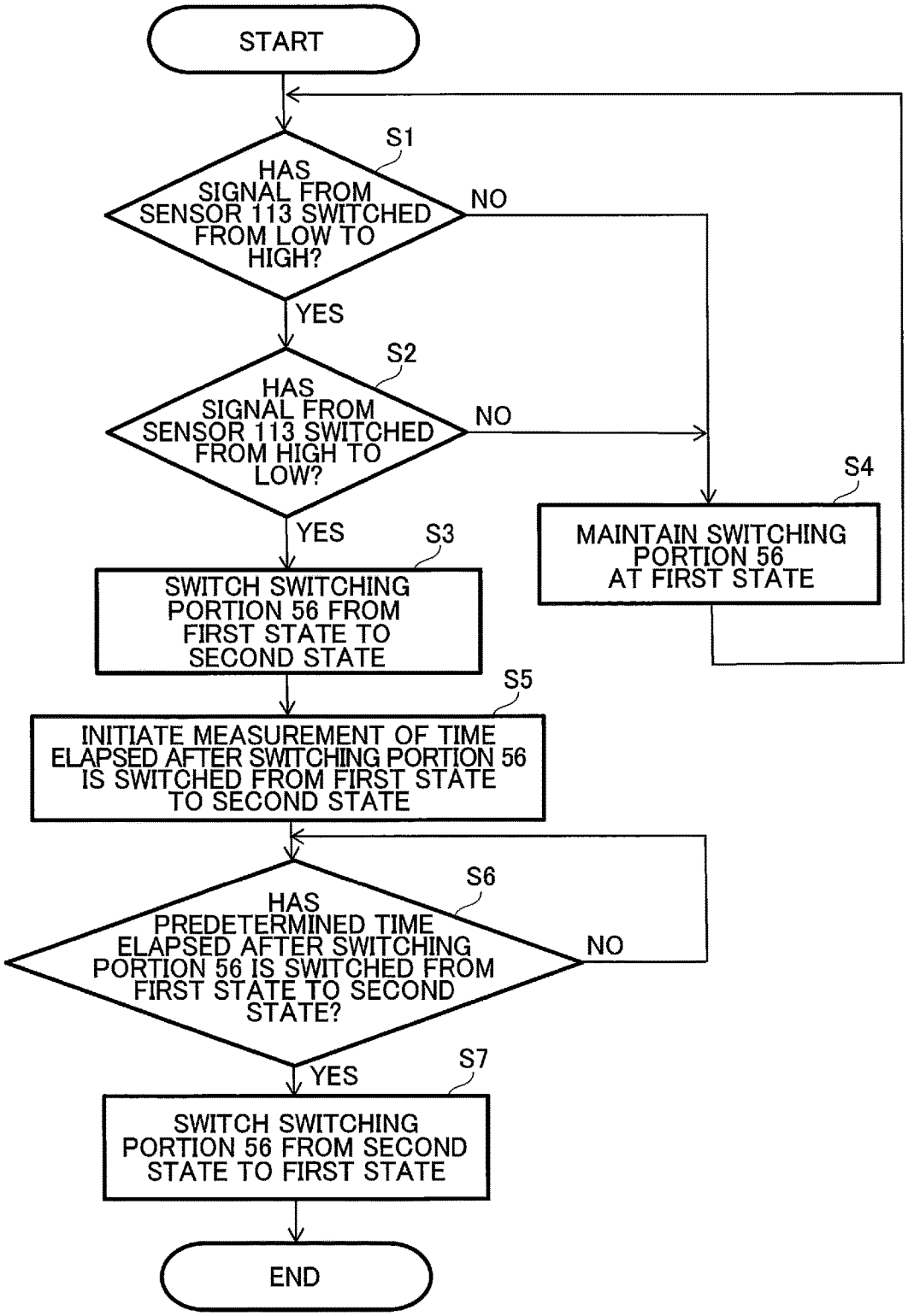
FIG. 9 is a flowchart illustrating steps in a process executed by the controller 130 for switching a switching portion 56 between a first state and a second state when a new ink cartridge 30 is attached to the cartridge attachment portion 110 according to the embodiment.

That is, in S1 of FIG. 9, the controller 130 determines whether the signal inputted into the controller 130 from the attachment sensor 113 has switched from a low level signal to a high level signal. When the signal inputted into the controller 130 from the attachment sensor 113 has switched from a low level signal to a high level signal (S1: YES), the controller 130 determines that the ink cartridge 30 has been detached from the cartridge attachment portion 110 and advances to step S2.

In S2 the controller 130 determines whether the signal inputted into the controller 130 from the attachment sensor 113 has switched from a high level signal to a low level signal. When the signal inputted into the controller 130 from the attachment sensor 113 has switched from a high level signal to a low level signal (S2: YES), the controller 130 determines that the ink cartridge 30 has been attached to the cartridge attachment portion 110 and advances to step S3 to switch the switching portion 56 from the first state to the second state.

If the signal inputted into the controller 130 from the attachment sensor 113 has not switched from a low level signal to a high level signal (S1: NO), the controller 130 determines that the ink cartridge 30 has not been detached from the cartridge attachment portion 110 and advances to step S4. In S4 the controller 130 maintains the switching portion 56 at the first state. Similarly, if the signal inputted into the controller 130 from the attachment sensor 113 has not switched from a high level signal to a low level signal (S2: NO) after the signal inputted into the controller 130 from the attachment sensor 113 has switched from the low level signal to the high level signal (S1: YES), the controller 130 determines that the ink cartridge 30 has not been attached to the cartridge attachment portion 110 and advances to step S4.

In other words, the controller 130 controls the switching portion 56 so that the passage resistance value at the air communication port 124 is set to one of a first value and a second value. Here, the first value is higher than the second value. When the switching portion 56 is at the first state, the passage resistance value at the air communication port 124 is set to the first value. When the switching portion 56 is at the second state, the passage resistance value at the air communication port 124 is set to the second value.

Incidentally, as the timing at which the ink cartridge 30 is replaced with a new one, a timing at which the controller 130 determines that the liquid level of the ink in the tank 103 is equal to or lower than the position P1 in the up-down direction 7 depending on the output of the liquid level sensor 55 and a warning indicative of necessity of replacement of the ink cartridge 30 is notified to a user is conceivable.

When the ink cartridge 30 attached to the cartridge attachment portion 110 is replaced with a new ink cartridge 30, the ink cartridge 30 in which no or little ink remains is detached from the cartridge attachment portion 110, and then, the ink cartridge 30 in which an initial capacity of ink is stored is attached to the cartridge attachment portion 110. At this time, the liquid level of the ink in the storage chambers 32 and 33 of the ink cartridge 30 is higher than the liquid level of the ink in the tank 103, that is, higher than the position P1. Therefore, due to hydraulic head difference, ink flows out of the ink cartridge 30 to the tank 103. At this time, because the switching portion 56 is at the second state, that is, because the passage resistance value at the air communication port 124 through which the tank 103 is open to the atmosphere is smaller when the switching portion 56 is at the second state than when the switching portion 56 is at the first state, ink easily flows from the ink cartridge 30 to the tank 103.

Incidentally, in a case where the multifunction peripheral 10 is brand-new and the user uses the multifunction peripheral 10 for the first time, a new ink cartridge 30 needs to be attached to the cartridge attachment portion 110. In this case, the controller 130 first determines whether the signal inputted into the controller 130 from the attachment sensor 113 has switched from a high level signal to a low level signal in S2 of FIG. 9.

When the signal inputted into the controller 130 from the attachment sensor 113 has switched from a high level to a low level signal (S2: YES), the controller 130 determines that the new ink cartridge 30 has been attached to the cartridge attachment portion 110 for the first time and advances to step S3 to switch the switching portion 56 from the first state to the second state. If the signal inputted into the controller 130 from the attachment sensor 113 has not switched from a high level signal to a low level signal (S2: NO), the controller 130 determines that the ink cartridge 30 has not yet been attached to the cartridge attachment portion 110 and advances to step S4 to maintain the switching portion 56 at the first state.

The controller 130 counts a time elapsed after the switching portion 56 is switched from the first state to the second state. When the controller 130 determines that a predetermined time preliminarily stored in the ROM 132 has elapsed, the controller 130 controls the operation of the switching portion 56 to switch the switching portion 56 from the second state to the first state. Note that the predetermined time is set as a time required for balancing the liquid level of the ink in the ink cartridge 30 with the initial capacity and the liquid level of the ink in the tank 103 whose liquid level of the ink is at the position P1.

That is, in S5 of FIG. 9, the controller 130 initiates a count for measuring a time elapsed after the switching portion 56 is switched from the first state to the second state in S3.

After the controller 130 initiates the count for measuring the elapsed time in S5, in S6 the controller 130 determines whether the amount of time elapsed after the count was initiated exceeds the predetermined time. If the predetermined time has elapsed (S6: YES), the controller 130 advances to step S7 to switch the switching portion 56 from the second state to the first state. If the predetermined time has not yet elapsed (S6: NO), the controller 130 repeats step S6 until the predetermined time has elapsed.

Next, a process executed by the controller 130 for switching the switching portion 56 between the first state and the second state during operation and non-operation of the recording portion 24. Here, the process executed by the controller 130 will be described in a case where the controller 130 controls the operation of the switching portion 56 that changes the passage resistance value at the air communication port 124A as an example. In a case where the controller 130 controls the operation of the switching portion 56 that changes the passage resistance value at the air communication port 124B, the controller 130 executes a process equivalent to the process executed at the time of controlling the operation of the switching portion 56 for changing the passage resistance value at the air communication port 124A.

During the operation of the recording portion 24 in the image recording process, the controller 130 controls the operation of the switching portion 56 to set the switching portion 56 to the first state. Here, the phrase "during the operation of the recording portion 24 in the image recording process" denotes that ink is ejected from the nozzles 29 of the recording head 21, or during a maintenance operation, purging is performed to discharge ink from the nozzles 29 of the recording head 21. When the switching portion 56 is at the first state, an amount of ink flowing from the storage chambers 32 and 33 of the ink cartridge 30 is greater than an amount of ink flowing from the storage chamber 121 of the tank 103.

Figure 10:
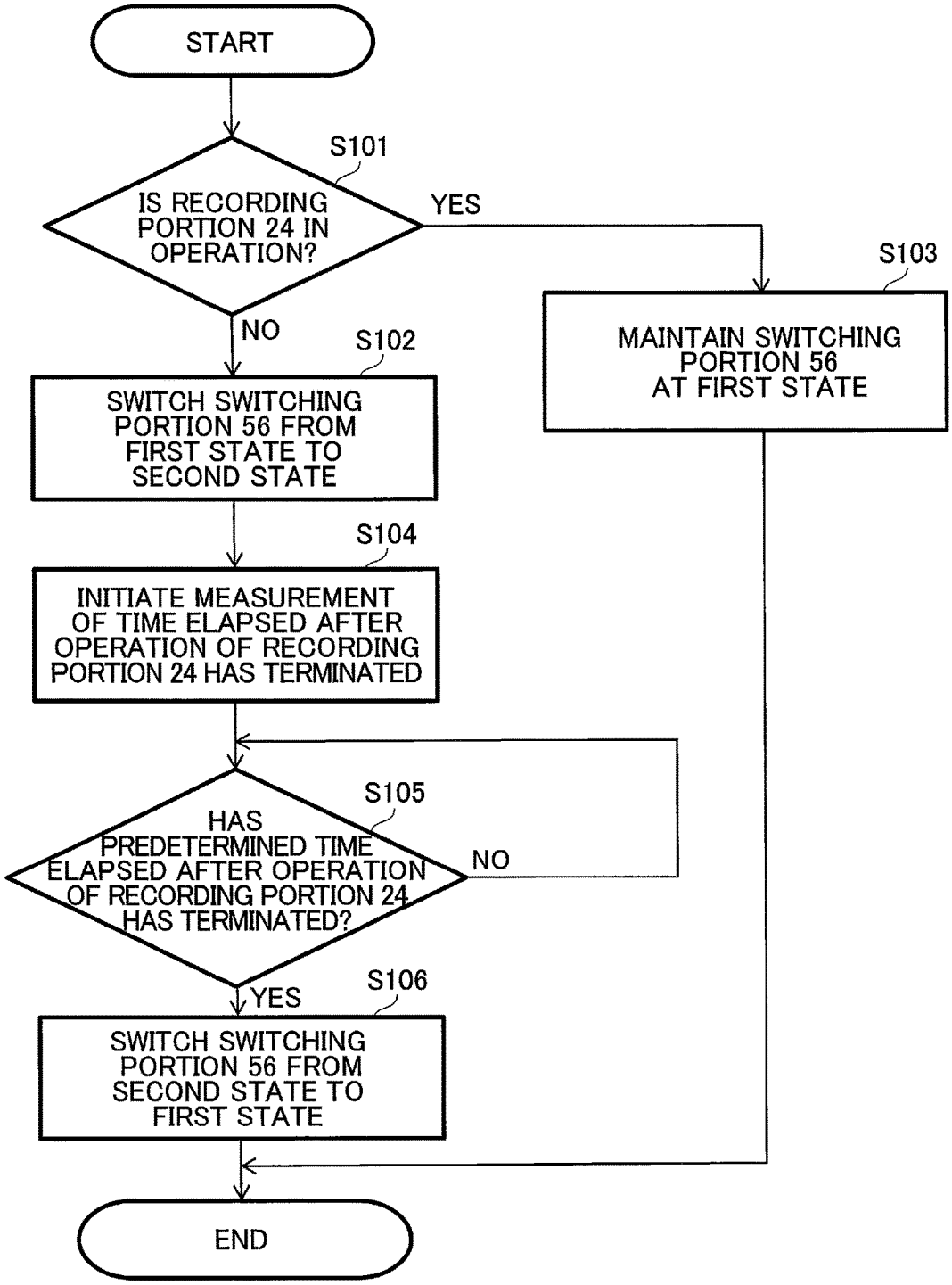
FIG. 10 is a flowchart illustrating steps in a process executed by the controller 130 for switching the switching portion 56 between the first state and the second state during an operation of a recording portion 24 according to the embodiment.

In S101 of FIG. 10, the controller 130 determines whether or not the recording portion 24 is in operation. If the controller 130 determines that the recording portion 24 is in operation (S101: YES), the controller 130 advances to step S103 and maintains the switching portion 56 at the first state.

On the other hand, the controller 130 controls the operation of the switching portion 56 to set the switching portion 56 to the second state when the recording unit 24 is not in operation, that is, when ink is not discharged from the nozzles 29 of the recording head 21.

Hence, if the controller 130 determines that the recording portion 24 is not in operation (S101: NO), the controller 130 advances to step S102 to switch the switching portion 56 from the first state to the second state.

In a case where the amount of ink flowing out of the storage chamber 121 of the tank 103 is different from the amount of ink flowing out of the storage chambers 32 and 33 of the ink cartridge 30 when ink is discharged from the nozzles 29 of the recording head 21, hydraulic head difference occurs between the liquid level of the ink in the tank 103 and the liquid level of the ink in the ink cartridge 30. Due to this hydraulic head difference, ink flows from one of the tank 103 and the ink cartridge 30 whose liquid level is the higher to the other of the tank 103 and the ink cartridge 30 whose liquid level is the lower. At this time, because the switching portion 56 is at the second state, that is, because the passage resistance value at the air communication port 124 through which the tank 103 is open to the atmosphere is smaller when the switching portion 56 is at the second state than that when the switching portion 56 is at the first state, ink easily flows between the ink cartridge 30 and the tank 103.

Incidentally, the timing at which the recording unit 24 is not in operation may be not only a timing at which the image recording process or the purging operation is not being performed, but also a timing at which, during the image recording process, ink is not ejected from the nozzles 29 of the recording head 21, for example, a standby time between pages.

The controller 130 counts the time after the operation of the recording unit 24 has terminated. When the controller 130 determines that the predetermined time preliminarily stored in the ROM 132 has elapsed, the controller 130 controls the operation of the switching portion 56 to switch the switching portion 56 from the second state to the first state. Note that the predetermined time is set as a time required for recovering the hydraulic head difference by predicting the hydraulic head difference between the liquid level of the ink in the ink cartridge 30 and the liquid level of the ink in the tank 103 depending on an amount of ink discharged from the recording head 21 during the image recording process or the purging operation.

Thus, in S104, the controller 130 initiates a count for measuring a time elapsed from the time the recording portion 24 has terminated its operation.

After the controller 130 initiates the count for measuring the elapsed time from the time the recording portion 24 has terminated its operation in S104, in S105 the controller 130 determines whether the amount of time elapsed after the count was initiated exceeds the predetermined time. If the predetermined time has elapsed (S105: YES), the controller 130 advances to step S106 to switch the switching portion 56 from the second state to the first state. If the predetermined time has not yet elapsed (S105: NO), the controller 130 repeats step S105 until the predetermined time has elapsed.

<Operational Advantages>

When ink is supplied from the storage chamber 121 of the tank 103 to the recording portion 24 through the communication port 128 and the ink outflow port 127, ink flows out of the storage chambers 32 and 33 of the ink cartridge 30 into the tank 103.

At this time, since the second passage resistance value R2 is greater than the product A×R1 obtained by multiplying the first average passage resistance value R1 by the cross-sectional area ratio A, a lowering speed of the liquid level of the ink stored in the first space of the storage chambers 32, 33 contained in the region Q is faster than a lowering speed of the liquid level of the ink stored in the second space of the storage chamber 121 of the tank 103 contained in the region Q.

Further, the switching portion 56 is capable of changing the second passage resistance value R2 at the air communication port 124 between the first value and the second value. By switching the switching portion 56 to set the second passage resistance value R2 at the air communication port 124 to the first value, the ink stored in the storage chambers 32 and 33 of the ink cartridge 30 is supplied to the recording portion 24 in priority to the ink stored in the storage chamber 121 of the tank 103. Hence, the liquid level of the ink in the storage chambers 32 and 33 of the ink cartridge 30 falls faster than that in the storage chamber 121 of the tank 103. Therefore, possibility of entry of the air into the recording portion 24 through the communication port 128 of the tank 103 caused by the storage chamber 121 of the tank 103 running out of ink before running out of ink in the storage chambers 32 and 33 can be suppressed. Further, the controller 130 can also be suppressed from making such determination that the liquid level of the ink stored in the storage chamber 121 of the tank 103 is equal to or lower than the position P1 even though a usable amount of ink still remains in the storage chamber 32 and 33.

Further, by switching the switching portion 56 from the first state to the second state to set the second passage resistance value R2 at the air communication port 124 to the second value, the second passage resistance value R2 at the air communication port 124 can be made smaller than that at the first value. Accordingly, ink can easily flow between the storage chamber 121 of the tank 103 and the storage chambers 32 and 33 of the ink cartridge 30. Specifically, when the ink cartridge 30 is replaced, or when ink is discharged from the nozzles 29 of the recording head 21, hydraulic head difference occurs between the liquid level of the ink in the tank 103 and the liquid level of ink in the ink cartridge 30. However, the time required for eliminating the hydraulic head difference, that is, the time required for balancing the liquid level of the ink in the storage chambers 32 and 33 of the ink cartridge 30 and the liquid level of the ink in the storage chamber 121 of the tank 103, can be shortened by setting the switching portion 56 to the second state. Thus, when it is necessary for the ink to smoothly flow between the storage chambers 32 and 33 of the ink cartridge 30 and the storage chamber 121 of the tank 103, the second passage resistance value R2 at the air communication port 124 can be set to the second value.

In addition, when the recording portion 24 is operated, the switching portion 56 is switched to the first state to set the second passage resistance value R2 at the air communication port 124 to the first value. Thus, the second passage resistance value R2 at the air communication port 124 can be made greater than that at the second value. When the second passage resistance value R2 at the air communication port 124 is at the first value, the amount of ink flowing out of the storage chamber 121 of the tank 103 can be reduced. Accordingly, possibility of entry of the air into the recording portion 24 through the communication port 128 of the tank 103 caused by the storage chamber 121 of the tank 103 running out of ink before running out of ink in the storage chambers 32 and 33 can be suppressed.

On the other hand, when the recording portion 24 is not operated, the switching portion 56 is switched to the second state to set the second passage resistance value R2 at the air communication port 124 to the second value. Thus, as described above, the second passage resistance value R2 at the air communication port 124 can be made smaller than that at the first value. Accordingly, ink easily flows between the storage chambers 32 and 33 of the ink cartridge 30 and the storage chamber 121 of the tank 103, and the time required for balancing the liquid level of the ink in the storage chambers 32 and 33 of the ink cartridge 30 and the liquid level of the ink in the storage chamber 121 of the tank 103 can be shortened.

As the first valve 162 and the second valve 165 are configured to open and close the first air passage 161 and the second air passage 164, respectively, the number of passages through which the tank 103 is open to an outside can change. Whit this configuration, the second passage resistance value R2 at the air communication port 124 can be changed.

Further, as the first valve 162 and the second valve 165 are configured to open and close the first air passage 161 and the second air passage 164, respectively, the semi-permeable membranes 160 and 163 are selectively open to an outside. Since each of the semi-permeable membranes 160 and 163 have different Gurley numbers from each other, the second passage resistance value R2 at the air communication port 124 can be changed.

<Modifications and Variations>

While the description has been made in detail with reference to the embodiments thereof, it would be apparent to those skilled in the art that many modifications and variations may be made therein without departing from the scope of the disclosure.

The configuration of the switching portion 56 described above may be appropriately changed as long as the switching portion 56 has a configuration capable of changing the passage resistance value at which air flows through a passage in the tank 103 or the storage chambers 32 and 33. For example, the second air passage 164 of the switching portion 56 may be open, without being sealed by the second semi-permeable membrane 163.

Figure 11A:
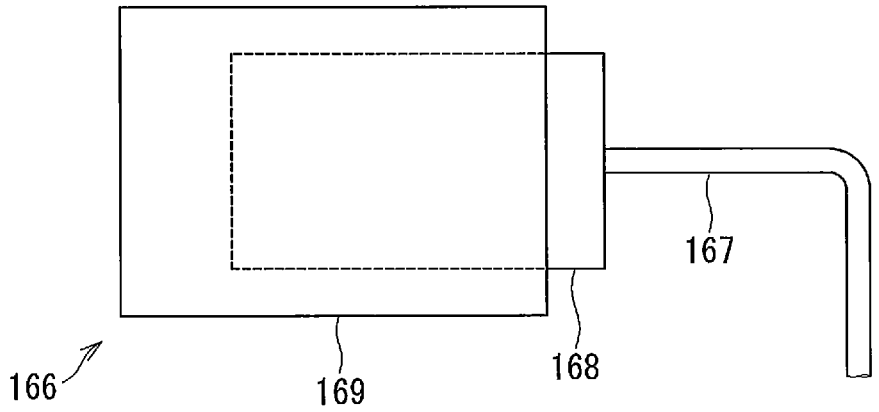
FIGS. 11A and 11B are schematic views illustrating a switching portion 166 according to one modification.
Figure 11B:
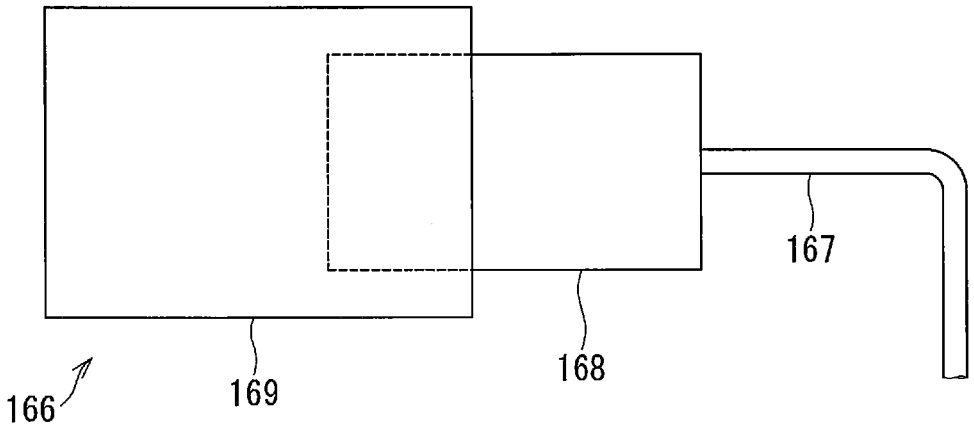

Further, in place of the switching portion 56, a switching portion 166 may be provided as illustrated in FIGS. 11A and 11B. The switching portion 166 includes an air passage 167, a semi-permeable membrane 168, and a cover 169. The air communication port 124 communicates with an outside through the air passage 167. The semi-permeable membrane 168 seals the air passage 167. The cover 169 is configured to change an area of the semi-permeable membrane 168 exposed to the air passage 167.

The cover 169 is driven by an actuator such as a motor, and the operation of the cover 169 is controlled by the controller 130. By changing the position of the cover 169, the area of the semi-permeable membrane 168 exposed to the air passage 167 is changed. That is, as illustrated in FIG. 11A, if the area of the semi-permeable membrane 168 exposed to the air passage 167 is small, a passage resistance value at the air passage 167 increases. On the other hand, as illustrated in FIG. 11B, if the area of the semi-permeable membrane 168 exposed to the air passage 167 is large, the passage resistance value at the air passage 167 decreases. In this way, by changing the exposed area of the semi-permeable membrane 168 by the cover 169, the second passage resistance value R2 at the air communication port 124 can be changed.

Figure 12A:
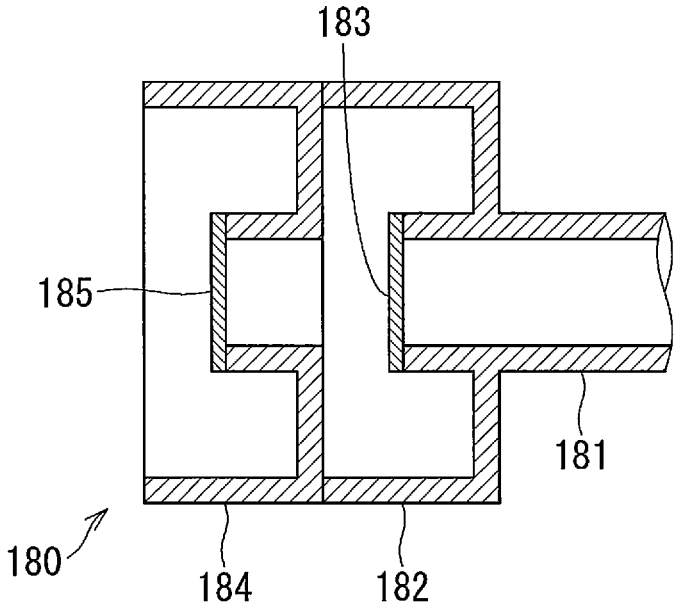
FIGS. 12A and 12B are schematic views illustrating a switching portion 180 according to another modification.
Figure 12B:
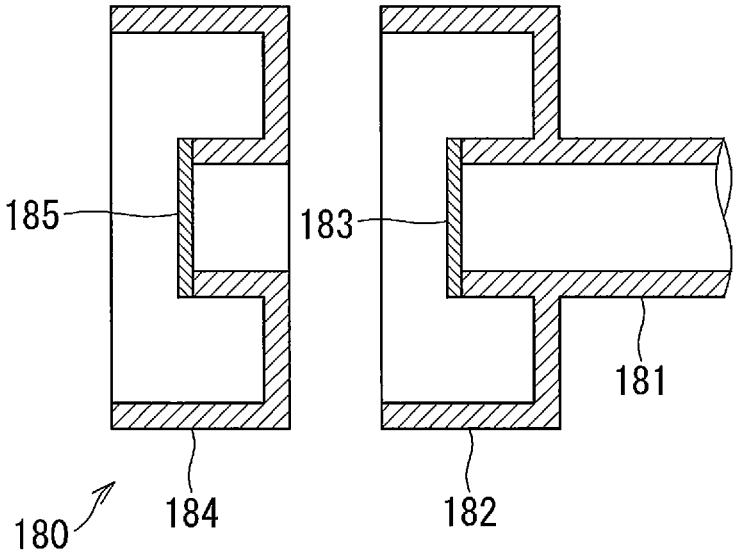

Further, in place of the switching portion 56, a switching portion 180 may be provided as illustrated in FIGS. 12A and 12B. The switching portion 180 includes an air passage 181, a first support portion 182, a semi-permeable membrane 183, a second support portion 184, and a semi-permeable membrane 185. The first support portion 182 has a passage that communicates with the air passage 181. The semi-permeable membrane 183 seals the passage of the first support portion 182. The second support portion 184 is capable of being connected to and separated from the first support portion 182 and has a passage that communicates with the passage of the first support portion when the second support portion 184 is connected to the first support portion 182. The semi-permeable membrane 185 seals the passage of the second support portion 184. The Gurley numbers of the semi-permeable membranes 183 and 185 may be the same as each other or different from each other.

The controller 130 controls a connected state between the first support portion 182 and the second support portion 184. Whether or not the semi-permeable membrane 185 seals the passage from the air passage 181 to an outside is changed depending on connection or separation between the first support portion 182 and the second support portion 184.

That is, when the second support portion 184 is connected to the first support portion 182 as illustrated in FIG. 12A, the air passage 181 communicates with the outside through the semi-permeable membranes 183 and 185. Accordingly, a passage resistance value at the air passage 181 increases. On the other hand, when the second support portion 184 is separated from the first support portion 182 as illustrated in FIG. 12B, the air passage 181 communicates with the outside through the semi-permeable membrane 183. Accordingly, the passage resistance value of the air passage 181 decreases. In this way, by changing the connected state between the second support portion 184 and the first support portion 182, the second passage resistance value R2 at the air communication port 124 can be changed.

Incidentally, the switching portions 56, 166, and 180 are connected to the air communication port 124 to change the second passage resistance value R2 at the air communication port 124. However, such a switching portion may be connected to the air communication port 96 to change the first passage resistance value R1.

Further, in the above-described embodiment, the semi-permeable membrane 80 is provided in the ink cartridge 30. However, the semi-permeable membrane 80 is not necessarily provided in the ink cartridge 30. The semi-permeable membrane 80 may be provided at any position of the air passage extending from an outside of the ink cartridge 30 to the storage chamber 32 in the attached state of the ink cartridge 30 to the cartridge attachment portion 110. For example, the semi-permeable membrane 80 may be provided in an air passage in communication with an internal space of the rod 125 of the cartridge attachment portion 110, in a case where, in the attached state of the ink cartridge 30 to the cartridge attachment portion 110, the air passage is constituted by an air passage that is provided in the internal space of the rod 125 of the cartridge attachment portion 110 and the air communication port 96 of the ink cartridge 30 that is in communication with the internal space of the rod 125.

In the above-described embodiment, the position of the horizontal plane including the boundary between the storage chamber 121 and the flow passage 123 in the up-down direction 7 is defined as the position P2, and the space between the position P1 and the position P2 is defined as the region Q. However, the position P2 may be a position different from the position in the above-described embodiment, and the region Q may be defined with the position P2 different from the above-described embodiment. For example, the position P2 is defined as a position lower than the boundary between the storage chamber 121 and the flow passage 123 in the up-down direction 7 but higher than the position P1, and the region Q may be defined with this position P2.

In the above-described embodiment, the ink supply port 71 is sealed with the valve 77. However, the ink supply port 71 may be sealed with a film instead of the valve 77. Further, the ink supply port 71 may be formed by piercing, with a needle or the like, a seal member formed of elastic resin and having no through-hole, and may be closed by elasticity of the seal member as the needle is extracted from the seal member. Further, the ink supply portion 34 does not need to be a cylindrical member. For example, a through-hole formed in the front wall 41 of the cartridge casing 31 may be configured as an ink supply portion.

Further, in the above-described embodiment, the controller 130 determines that the liquid level of the ink stored in the storage chamber 121 of the tank 103 and the liquid level of the ink stored in the storage chamber 33 of the ink cartridge 30 are positioned lower than or equal to the position P1 in the up-down direction 7 when the signal outputted from the liquid level sensor 55 to the controller 130 switches from a low level signal to a high level signal due to the change in posture of the pivoting member 50.

However, the controller 130 may determine that the liquid level of the ink stored in the storage chamber 121 of the tank 103 and the liquid level of the ink stored in the storage chamber 33 of the ink cartridge 30 are positioned lower than or equal to the position P1 in the up-down direction 7 at times other than the above.

For example, the controller 130 may count the number of dots of ink droplets ejected from the recording head 21 after the signal outputted from the liquid level sensor 55 to the controller 130 switches from a low level signal to a high level signal due to the change in posture of the pivoting member 50. In this case, the controller 130 may determine that the liquid level of the ink stored in the storage chamber 121 of the tank 103 and the liquid level of the ink stored in the storage chamber 33 of the ink cartridge 30 are positioned at a predetermined position lower than the position P1 in the up-down direction 7 when the count value of the dot is greater than or equal to a predetermined value. Incidentally, the predetermined value may be set on a basis of an internal volume of a portion of the storage chamber 121 positioned below the connecting portion 107.

In the above-described embodiment, the attachment sensor 113 and the liquid level sensor 55 are optical sensors each having the light-emitting portion and the light-receiving portion. However, the attachment sensor 113 and the liquid level sensor 55 may be sensors of a type different from the optical sensor, such as a proximity sensor.

In the above-described embodiment, the liquid level of the ink stored in the storage chamber 121 of the tank 103 becoming lower than the position P1 is determined on a basis of detection of pivotal movement of the pivoting member 50 disposed in the storage chamber 121 of the tank 103. However, the determination may be performed by any method other than the detection of pivotal movement of the pivoting member 50.

For example, a prism may be disposed in the storage chamber 121 of each tank 103 at a height the same as the position P1. Whether the liquid level of the ink stored in the storage chamber 121 of the tank 103 is lower than or equal to the position P1 may be determined on a basis of a travelling direction of light incident on the prism that is different depending on whether or not the liquid level is higher than the prism.

Further, for example, two electrodes may be disposed in the storage chamber 121 of each tank 103. One of the two electrodes may have a lower end at a position slightly higher than the position P1, while the other of the two electrodes may have a lower end at a position below the position P1. Whether the liquid level of the ink stored in the storage chamber 121 of the tank 103 is lower than or equal to the position P1 may be determined on a basis of detection whether or not current flows between the two electrodes through the ink.

Further, detecting portions such as the pivoting member 50, the liquid level sensor 55, and the like may be provided in the storage chamber 32 of the ink cartridge 30, instead of the tank 103.

In the above-described embodiment, the connecting portion 107 of the cartridge attachment portion 110 and the ink supply portion 34 of the ink cartridge 30 both extend in the horizontal direction. Further, the ink cartridge 30 is attached to the cartridge attachment portion 110 by being inserted into the cartridge attachment portion 110 in the horizontal direction. At this time, the connecting portion 107 and the ink supply portion 34 are connected to each other in the horizontal direction. However, the ink cartridge 30 may be attached to the cartridge attachment portion 110 by being inserted into the cartridge attachment portion 110 in a direction other than the horizontal direction, for example, in the up-down direction 7.

In this case, for example, the connecting portion 107 may protrude upward from the case 101 while the ink supply portion 34 may protrude downward from the bottom wall of the ink cartridge 30. Incidentally, in this case, the position P1 may be set, for example, at a center position of the connecting portion 107 in the up-down direction 7 or a center position of the ink supply portion 34 in the up-down direction 7.

In the above-described embodiment, ink serves as an example of a liquid. However, for example, in place of ink, a pretreatment liquid that is ejected onto the recording paper prior to the ink during an image recording operation may be stored in the ink cartridge 30 and the tank 103. Alternatively, water that is used for cleaning the recording head 21 may be stored in the ink cartridge 30 and the tank 103.

<Remarks>

The multifunction peripheral 10 is an example of an image recording apparatus. The ink cartridge 30 is an example of a cartridge. The storage chamber 32 and the storage chamber 33 are an example of a first storage chamber. The air communication port 96 is an example of a first air communication portion. The ink supply portion 34 is an example of a first supply portion. The storage chamber 121 and the flow passage 123 are an example of a second storage chamber. The air communication port 124 is an example of a second air communication portion. The storage chamber 121 is an example of a first part. The flow passage 123 is an example of a second part. The first air passage 161 and the second air passage 164 are an example of a plurality of air passages. The first semi-permeable membrane 160 and the second semi-permeable membrane 163 are an example of a plurality of semi-permeable membrane. The first valve 162 and the second valve 165 are an example of a plurality of valve. The attachment sensor 113 is an example of a detecting portion.

What is claimed is:

1. An image recording apparatus comprising:

a cartridge comprising:

a first storage chamber configured to store a liquid therein;

a first air communication portion allowing the first storage chamber to communicate with an atmosphere; and a first supply portion configured to supply the liquid stored in the first storage chamber;

a cartridge attachment portion comprising:

a connecting portion configured to be connected to the first supply portion;

a second storage chamber configured to store therein the liquid supplied from the first supply portion connected to the connecting portion; and a second air communication portion allowing the second storage chamber to communicate with the atmosphere;

a recording portion comprising a nozzle through which liquid supplied from the second storage chamber is ejected; and a switching portion configured to change a passage resistance value of a flow of air flowing through one of the first air communication portion and the second air communication portion, wherein an inequality of $R2>A\times R1$ is met, in which R1: a first passage resistance value obtained by a sum of the passage resistance value of the flow of air flowing through the first air communication portion and a passage resistance value of a flow of the liquid flowing through the first supply portion;

R2: a second passage resistance value of the flow of air flowing through the second air communication portion; and A: a cross-sectional area ratio obtained by dividing a first average cross-sectional area by a second average cross-sectional area, in which the first average cross-sectional area is an average cross-sectional area of a first space of the first storage chamber, the first space containing a portion adjacent to the first supply portion and storing the liquid, and the second average cross-sectional area is an average cross-sectional area of a second space of the second storage chamber, the second space having a height the same as that of the first space and containing a portion in which the liquid is stored.

2. The image recording apparatus according to claim 1, wherein the second storage chamber comprises:

a first part; and a second part positioned above the first part and having a cross-sectional area smaller than that of the first part, and wherein the second space spans from a boundary between the first part and the second part to the connecting portion.

3. The image recording apparatus according to claim 1, wherein the switching portion is configured to change at least one of the passage resistance value at the first air communication portion and the passage resistance value at the second air communication portion.

4. The image recording apparatus according to claim 3, wherein the switching portion comprises:

a plurality of air passages providing communication between the second storage chamber and the atmosphere;

a plurality of semi-permeable membranes each sealing corresponding one of the plurality of air passages; and a plurality of valves each configured to open and close corresponding one of the plurality of air passages.

5. The image recording apparatus according to claim 4, wherein the plurality of semi-permeable membranes includes membranes having Gurley numbers different from each other.

6. The image recording apparatus according to claim 3, wherein the switching portion comprises:

an air passage providing communication between the second storage chamber and the atmosphere;

a semi-permeable membrane sealing the air passage; and a cover configured to change an area of the semi-permeable membrane exposed to the air passage.

7. The image recording apparatus according to claim 3, further comprising:

a controller configured to control operation of the switching portion to set the passage resistance value at the second air communication portion to one of a first value and a second value, the first value being higher than the second value; and a detecting portion configured to detect attachment of the cartridge to the cartridge attachment portion, wherein the controller operates the switching portion to set the passage resistance value at the second air communication portion to the second value subject to receipt of a signal indicative of the attachment of the cartridge to the cartridge attachment portion from the detecting portion after the cartridge is detached from the cartridge attachment portion, the controller further operating the switching portion to set the passage resistance value at the second air communication portion to the first value during operation of the recording portion.

8. The image recording apparatus according to claim 3, further comprising a controller configured to control operation of the switching portion to set the passage resistance value at the second air communication portion to one of a first value and a second value, the first value being higher than the second value, wherein the controller operates the switching portion to set the passage resistance value at the second air communication portion to the first value during operation of the recording portion and to set the passage resistance value at the second air communication portion to the second value during non-operation of the recording portion.

9. An image recording apparatus comprising:

a cartridge comprising:

a first storage chamber configured to store a liquid therein;

a first air communication portion allowing the first storage chamber to communicate with an atmosphere; and a first supply portion configured to supply the liquid stored in the first storage chamber;

a cartridge attachment portion comprising:

a connecting portion configured to be connected to the first supply portion;

a second storage chamber configured to store therein the liquid supplied from the first supply portion connected to the connecting portion; and a second air communication portion allowing the second storage chamber to communicate with the atmosphere;

a recording portion comprising a nozzle through which liquid supplied from the second storage chamber is ejected;

a switching portion configured to change a passage resistance value of a flow of air flowing through the second air communication portion;

a controller configured to control operation of the switching portion to set the passage resistance value at the second air communication portion to one of a first value and a second value, the first value being higher than the second value; and a detecting portion configured to detect attachment of the cartridge to the cartridge attachment portion, wherein the controller operates the switching portion to set the passage resistance value at the second air communication portion to the second value subject to receipt of a signal indicative of a change from non-attachment to attachment of the cartridge to the cartridge attachment portion from the detecting portion, the controller further operating the switching portion to set the passage resistance value at the second air communication portion to the first value during operation of the recording portion.

10. An image recording apparatus comprising:

a cartridge comprising:

a first storage chamber configured to store a liquid therein;

a first air communication portion allowing the first storage chamber to communicate with an atmosphere; and a first supply portion configured to supply the liquid stored in the first storage chamber;

a cartridge attachment portion comprising:

a connecting portion configured to be connected to the first supply portion;

a second storage chamber configured to store therein the liquid supplied from the first supply portion connected to the connecting portion; and a second air communication portion allowing the second storage chamber to communicate with the atmosphere;

a recording portion comprising a nozzle through which liquid supplied from the second storage chamber is ejected;

a switching portion configured to change a passage resistance value of a flow of air flowing through the second air communication portion; and a controller configured to control operation of the switching portion to set the passage resistance value at the second air communication portion to one of a first value and a second value, the first value being higher than the second value, wherein the controller operates the switching portion to set the passage resistance value at the second air communication portion to the first value during operation of the recording portion and to set the passage resistance value at the second air communication portion to the second value during non-operation of the recording portion.

* * * * *